US010832515B2

(12) United States Patent
DiCarlo

(10) Patent No.: US 10,832,515 B2
(45) **Date of Patent: *Nov. 10, 2020**

(54) SLOT GAME WITH ADDITIONAL SKILL ELEMENT

(71) Applicant: Pure Skill Games Limited, Vaughan (CA)

(72) Inventor: Fernando DiCarlo, Woodbridge (CA)

(73) Assignee: Pure Skill Games Limited (CA)

( * ) Notice: Subject to any disclaimer, the term of this patent is extended or adjusted under 35 U.S.C. 154(b) by 353 days.

This patent is subject to a terminal disclaimer.

(21) Appl. No.: 14/938,045

(22) Filed: Nov. 11, 2015

(65) Prior Publication Data

US 2016/0180638 A1 Jun. 23, 2016

Related U.S. Application Data

(63) Continuation of application No. 14/143,629, filed on Dec. 30, 2013, which is a continuation-in-part of application No. 13/936,189, filed on Jul. 7, 2013, now Pat. No. 9,017,158, which is a continuation of application No. 13/077,841, filed on Mar. 31, 2011, now Pat. No. 8,491,376.

(51) Int. Cl.
*G07F 17/32* (2006.01)
*G07F 17/34* (2006.01)

(52) U.S. Cl.
CPC ..... *G07F 17/3213* (2013.01); *G07F 17/32* (2013.01); *G07F 17/3267* (2013.01); *G07F 17/34* (2013.01); *G07F 17/3286* (2013.01); *G07F 17/3295* (2013.01)

(58) Field of Classification Search
CPC .. G07F 17/3213; G07F 17/32; G07F 17/3267; G07F 17/34; G07F 17/3286; G07F 17/3295
See application file for complete search history.

(56) References Cited

U.S. PATENT DOCUMENTS 5,980,384 A 11/1999 Barri
6,174,237 B1 1/2001 Stephenson
6,311,976 B1 11/2001 Yoseloff
6,537,150 B1 * 3/2003 Luciano ..... G07F 17/3244 273/138.2

(Continued)

OTHER PUBLICATIONS

International Search Report in PCT application PCT/US2015/062933.

(Continued)

*Primary Examiner* — Tramar Y Harper
*Assistant Examiner* — Jeffrey K Wong
(74) *Attorney, Agent, or Firm* — Muskin and Farmer LLC

(57) ABSTRACT

A method, apparatus, and computer readable storage to implement a slot machine (or other game) with a reveal list feature. When the player wants to view the reveal list (e.g., by pressing a button), the next X (e.g., 100) outcomes on the slot machine will be revealed. Thus, as the player plays these next 100 games, the outcomes will be exactly as listed in the reveal screen. Thus, the player will know what the next 100 games will result in. In an embodiment, the outcomes in the reveal list will be applied to a skill meter which can decrease (or in some embodiments also potentially increase) the outcome depending on mechanical skill of the player.

17 Claims, 24 Drawing Sheets

(56) References Cited

U.S. PATENT DOCUMENTS

| | | | | |
|---|---|---|---|---|
| 6,843,720 | B2 | 1/2005 | Luciano | |
| 7,736,223 | B2 | 6/2010 | Pace | |
| 8,118,660 | B2 | 2/2012 | Pace | |
| 8,469,792 | B2 | 6/2013 | Pace | |
| 8,920,231 | B2 | 12/2014 | Pace | |
| 9,501,896 | B2 | 11/2016 | Pace | |
| 10,204,482 | B2 | 2/2019 | Pace | |
| 2004/0018871 | A1* | 1/2004 | Seelig | G07F 17/32 463/20 |
| 2004/0048646 | A1* | 3/2004 | Visocnik | G07F 17/32 463/16 |
| 2004/0053661 | A1 | 3/2004 | Jones | |
| 2005/0202866 | A1 | 9/2005 | Luciano | |
| 2006/0214376 | A1 | 9/2006 | Weller | |
| 2007/0218972 | A1* | 9/2007 | Gerson | G07F 17/3258 463/20 |
| 2007/0298867 | A1* | 12/2007 | Huang | G07F 17/32 463/25 |
| 2008/0064459 | A1* | 3/2008 | Kelly | G01C 21/34 463/7 |
| 2009/0192938 | A1 | 7/2009 | Amos | |
| 2010/0004045 | A1 | 1/2010 | Roemer | |

OTHER PUBLICATIONS

International Search Report in PCT application PCT/US2015/030563.

* cited by examiner

LINE 1

| | | | | |
|---|---|---|---|---|
| X | X | X | X | X |
| | | | | |
| | | | | |

LINE 2

| | | | | |
|---|---|---|---|---|
| | | | | |
| X | X | X | X | X |
| | | | | |

LINE 3

| | | | | |
|---|---|---|---|---|
| | | | | |
| | | | | |
| X | X | X | X | X |

LINE 4

| | | | | |
|---|---|---|---|---|
| X | X | | | |
| | | | X | X |
| | | X | | |

LINE 5

| | | | | |
|---|---|---|---|---|
| | | | | |
| | | | X | X |
| X | X | X | | |

LINE 6

| | | | | |
|---|---|---|---|---|
| X | | | | X |
| | X | | X | |
| | | X | | |

LINE 7

| | | | | |
|---|---|---|---|---|
| | | X | | |
| | X | | X | |
| X | | | | X |

LINE 8

| | | | | |
|---|---|---|---|---|
| | X | X | X | |
| X | | | | X |
| | | | | |

LINE 9

| | | | | |
|---|---|---|---|---|
| | | | | |
| X | | | | X |
| | X | X | X | |

| | | | |
|---|---|---|---|
| $10,000 | | $500 | |
| $2,500 | | $300 | |
| $1,000 | | $150 | |
| $500 | | | |
| $5,000 | | $400 | |
| $3,000 | | $250 | |
| $900 | | $100 | |
| $2,500 | | $250 | |
| $1,000 | | $100 | |
| $500 | | $50 | |
| $1,000 | | | |
| $500 | | | |
| $250 | | | |
| $750 | | | |
| $400 | | | |
| $200 | | | |

PAYOUTS

FIGURE 11

NEXT 100 POTENTIAL WINS

| | | | | | | | |
|---|---|---|---|---|---|---|---|
| 1 | 0 | 26 | 0 | 51 | 0 | 76 | 0 |
| 2 | 0 | 27 | 0 | 52 | 0 | 77 | 0 |
| 3 | 0 | 28 | 0 | 53 | 0 | 78 | 0 |
| 4 | 50 | 29 | 0 | 54 | 0 | 79 | 0 |
| 5 | 100 | 30 | 0 | 55 | 50 | 80 | 0 |
| 6 | 0 | 31 | 0 | 56 | 0 | 81 | 0 |
| 7 | 0 | 32 | 0 | 57 | 0 | 82 | 0 |
| 8 | 0 | 33 | 0 | 58 | 0 | 83 | 0 |
| 9 | 0 | 34 | 0 | 59 | 0 | 84 | 0 |
| 10 | 0 | 35 | 0 | 60 | 0 | 85 | 0 |
| 11 | 0 | 36 | 0 | 61 | 0 | 86 | 0 |
| 12 | 0 | 37 | 0 | 62 | 100 | 87 | 0 |
| 13 | 0 | 38 | 50 | 63 | 0 | 88 | 50 |
| 14 | 0 | 39 | 0 | 64 | 0 | 89 | 0 |
| 15 | 0 | 40 | 0 | 65 | 0 | 90 | 0 |
| 16 | 0 | 41 | 0 | 66 | 0 | 91 | 0 |
| 17 | 0 | 42 | 0 | 67 | 0 | 92 | 0 |
| 18 | 50 | 43 | 0 | 68 | 100 | 93 | 0 |
| 19 | 0 | 44 | 0 | 69 | 100 | 94 | 0 |
| 20 | 250 | 45 | 100 | 70 | 0 | 95 | 0 |
| 21 | 0 | 46 | 0 | 71 | 0 | 96 | 0 |
| 22 | 0 | 47 | 0 | 72 | 0 | 97 | 2 |
| 23 | 0 | 48 | 0 | 73 | 0 | 98 | 0 |
| 24 | 0 | 49 | 0 | 74 | 50 | 99 | 0 |
| 25 | 0 | 50 | 0 | 75 | 0 | 100 | 1,000 |

RETURN TO GAME

1700^

1701

FIGURE 17

NEXT 100 POTENTIAL WINS

| | | | | | | | |
|---|---|---|---|---|---|---|---|
| 1 | 0 | 26 | 0 | 51 | 0 | 76 | 0 |
| 2 | 0 | 27 | 0 | 52 | 0 | 77 | 0 |
| 3 | 50 | 28 | 0 | 53 | 0 | 78 | 0 |
| 4 | 100 | 29 | 0 | 54 | 50 | 79 | 0 |
| 5 | 0 | 30 | 0 | 55 | 0 | 80 | 0 |
| 6 | 0 | 31 | 0 | 56 | 0 | 81 | 0 |
| 7 | 0 | 32 | 0 | 57 | 0 | 82 | 0 |
| 8 | 0 | 33 | 0 | 58 | 0 | 83 | 0 |
| 9 | 0 | 34 | 0 | 59 | 0 | 84 | 0 |
| 10 | 0 | 35 | 0 | 60 | 0 | 85 | 0 |
| 11 | 0 | 36 | 0 | 61 | 100 | 86 | 0 |
| 12 | 0 | 37 | 50 | 62 | 0 | 87 | 50 |
| 13 | 0 | 38 | 0 | 63 | 0 | 88 | 0 |
| 14 | 0 | 39 | 0 | 64 | 0 | 89 | 0 |
| 15 | 0 | 40 | 0 | 65 | 0 | 90 | 0 |
| 16 | 0 | 41 | 0 | 66 | 0 | 91 | 0 |
| 17 | 50 | 42 | 0 | 67 | 100 | 92 | 0 |
| 18 | 0 | 43 | 0 | 68 | 100 | 93 | 0 |
| 19 | 250 | 44 | 100 | 69 | 0 | 94 | 0 |
| 20 | 0 | 45 | 0 | 70 | 0 | 95 | 0 |
| 21 | 0 | 46 | 0 | 71 | 0 | 96 | 2 |
| 22 | 0 | 47 | 0 | 72 | 0 | 97 | 0 |
| 23 | 0 | 48 | 0 | 73 | 50 | 98 | 0 |
| 24 | 0 | 49 | 0 | 74 | 0 | 99 | 1,000 |
| 25 | 0 | 50 | 0 | 75 | 0 | 100 | 0 |

RETURN TO GAME

1800^

FIGURE 18

SLOT GAME WITH ADDITIONAL SKILL ELEMENT

CROSS REFERENCE TO RELATED APPLICATIONS

This application is a continuation in part of application Ser. No. 13/936,189, which is a continuation of application Ser. No. 13/077,841, both applications of which are incorporated by reference herein in their entireties.

BACKGROUND OF THE INVENTION

Field of the Invention

The present general inventive concept is directed to a method, apparatus, and computer readable storage medium directed to a slot machine game.

SUMMARY OF THE INVENTION

It is an aspect of the present invention to provide an exciting skill based slot machine game.

The above aspects can be obtained by a method that includes (a) providing an input device, an output device, and a processing unit operationally connected to the input device and the output device; (b) executing instructions on the processing unit to perform a following operations: (c) receiving a command by a player to activate a game; (d) completing the game on the output device to a game outcome; (e) determining a potential award based on the game outcome; (f) animating an icon until the player presses a stop button which causes the icon to become a frozen icon; (g) determining an earned percentage based on a position of the frozen icon; (h) computing an actual award by applying the earned percentage to the potential award; and (i) awarding the player the actual award.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 11 is a drawing of exemplary rules for a slot game, according to an embodiment;

FIG. 17 is a drawing of an exemplary screen shot of a forward reveal list, according to an embodiment;

FIG. 18 is a drawing of an exemplary screen shot of a successive forward reveal list, according to an embodiment;

DESCRIPTION OF THE PREFERRED EMBODIMENTS

Figure 1:
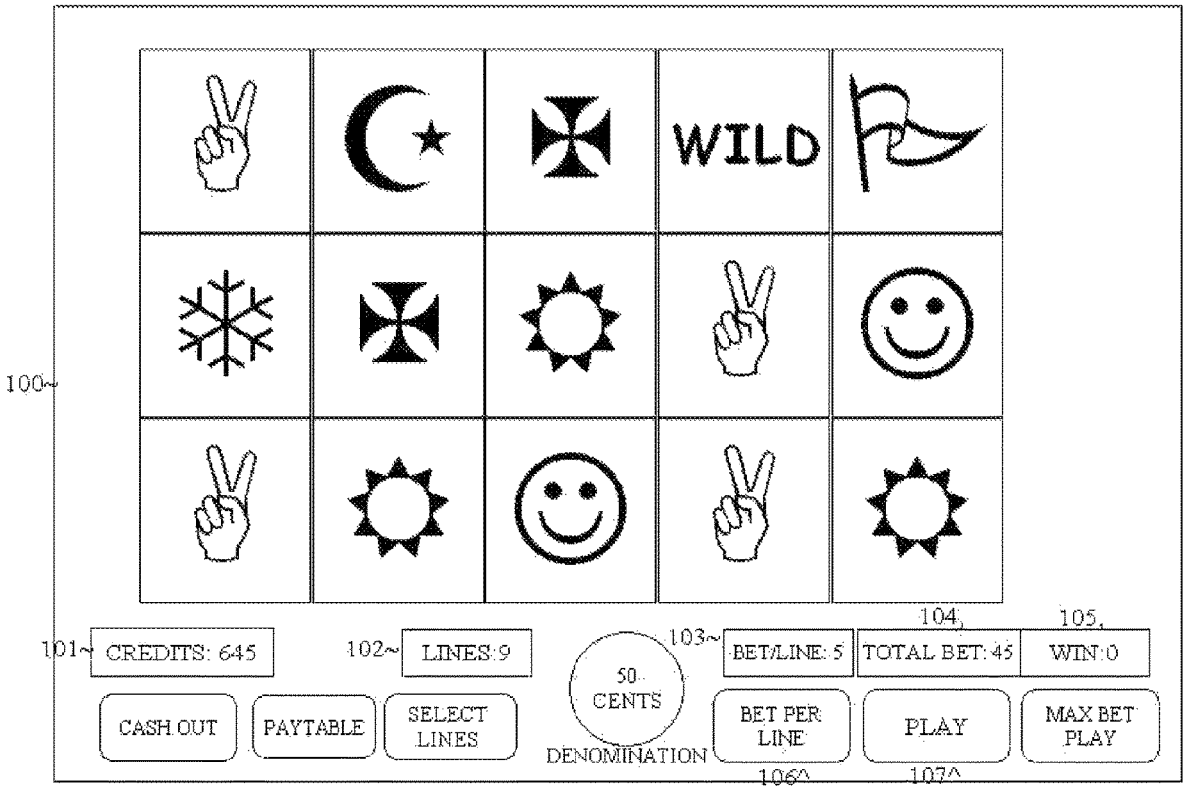
FIG. 1 is a drawing of a slot machine style of game when a player makes an entry/bet, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a slot machine game that incorporates a skill aspect. A typical slot machine game can be implemented, for example as described in U.S. Pat. No. 7,749,063, which is incorporated by reference herein in its entirety. As known in the art, a player makes a wager (using credits which can be exchanged for cash) and spins reels on a slot machine. The reels stop at random positions, and certain predetermined combinations on active paylines (each payline is predetermined line of symbols) will win awards (combinations that are not predetermined combinations do not pay awards). A payout (award) made to the player is the respective award for each active (bet on) payline added together.

Typically, when reels stop spinning and the reels form predetermined combinations, the player wins a respective award which is added to the player's credit meter (which can be cashed out at any point in time by the player). According to the present inventive concept, the after the reels stop spinning the amount the player would win (all awards for all active paylines) is considered a "potential win" and is not yet awarded the player. The player then plays a skill game (element) in which the player tries to earn 100% of the potential win by manipulating physical controls in order to achieve a goal. If the player completes the goal perfectly the player will win 100% of the potential win. If the player does not complete the goal perfectly, the player will win less than 100% of the potential win.

Some jurisdictions only allow wagering on games of skill. Thus, the skill element as described herein would add an element of skill to a traditional slot machine game, or any other potential game that awards a prize (e.g., video poker, bingo, keno, etc.)

FIG. 1 is a drawing of a slot machine style of game when a player makes an entry/bet, according to an embodiment. "Wager" and "bet" as used herein are synonymous.

An electronic output device 100 displays the game. A credit meter 101 shows how many credits (or points, sweepstakes, points, etc.) the player currently has. A line meter 102 shows how many paylines (lines) the player bets on (in this example game the game has a maximum of 9 lines). A bet per line meter 103 shows how many credits per line the player is betting on. A total bet meter 104 shows the player's total bet (typically this amount is equal to the bet per line multiplied by the number of lines bet). A win meter 105 shows how many credits the player has won on the last spin. A bet per line button 106 allows the player to set his or her bet per line (e.g., number of credits per line). A play button 107 allows the player to play (spin the reels using the parameters the player has chosen).

Figure 2:
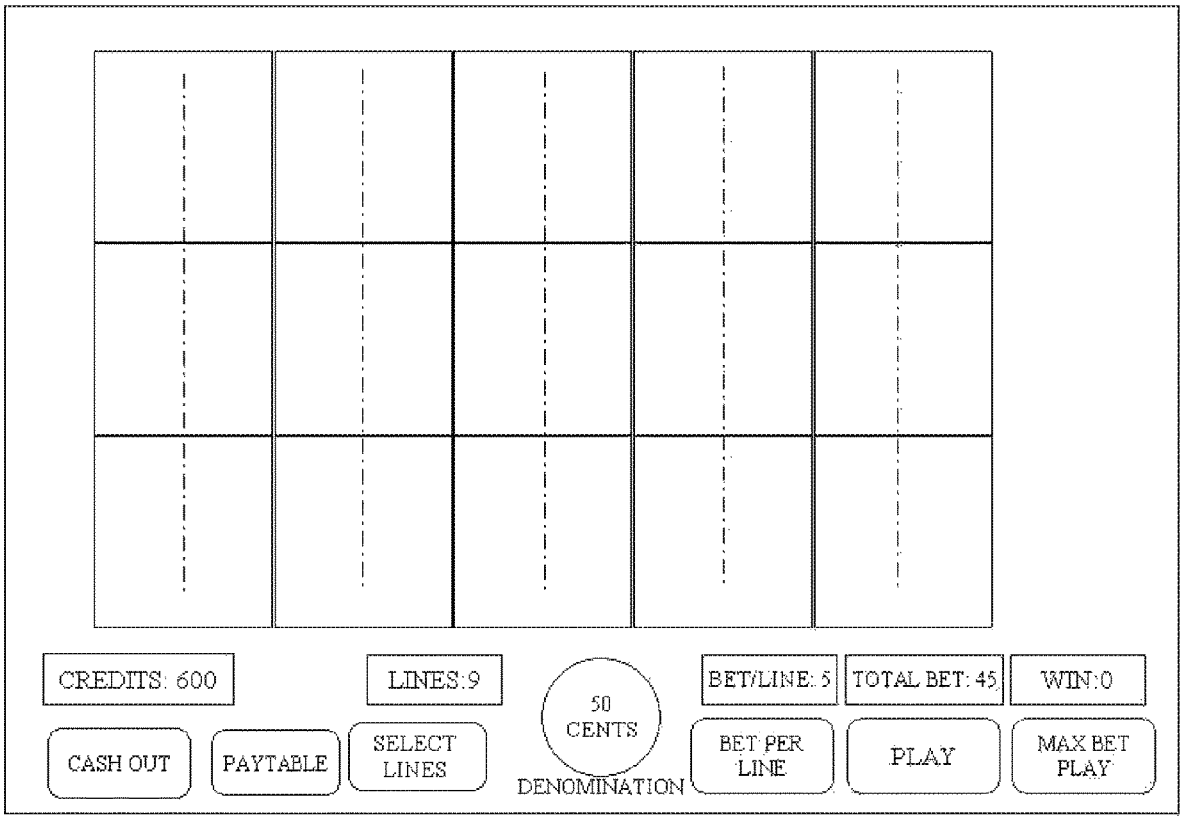
FIG. 2 is a drawing of a slot machine game when the player spins the reels, according to an embodiment.

FIG. 2 is a drawing of a slot machine game when the player spins the reels, according to an embodiment.

After the player presses the play (or spin or reveal) button 107 in FIG. 1, the reels spin as illustrated in FIG. 2. The spin typically lasts for about a second and each of the five reels stops at a random position. Each reel can have a predetermined number of symbols on it, for example 24, 36 or any other number. Reels can be physical (mechanical) or virtual (displayed on an electronic output device).

Figure 3:
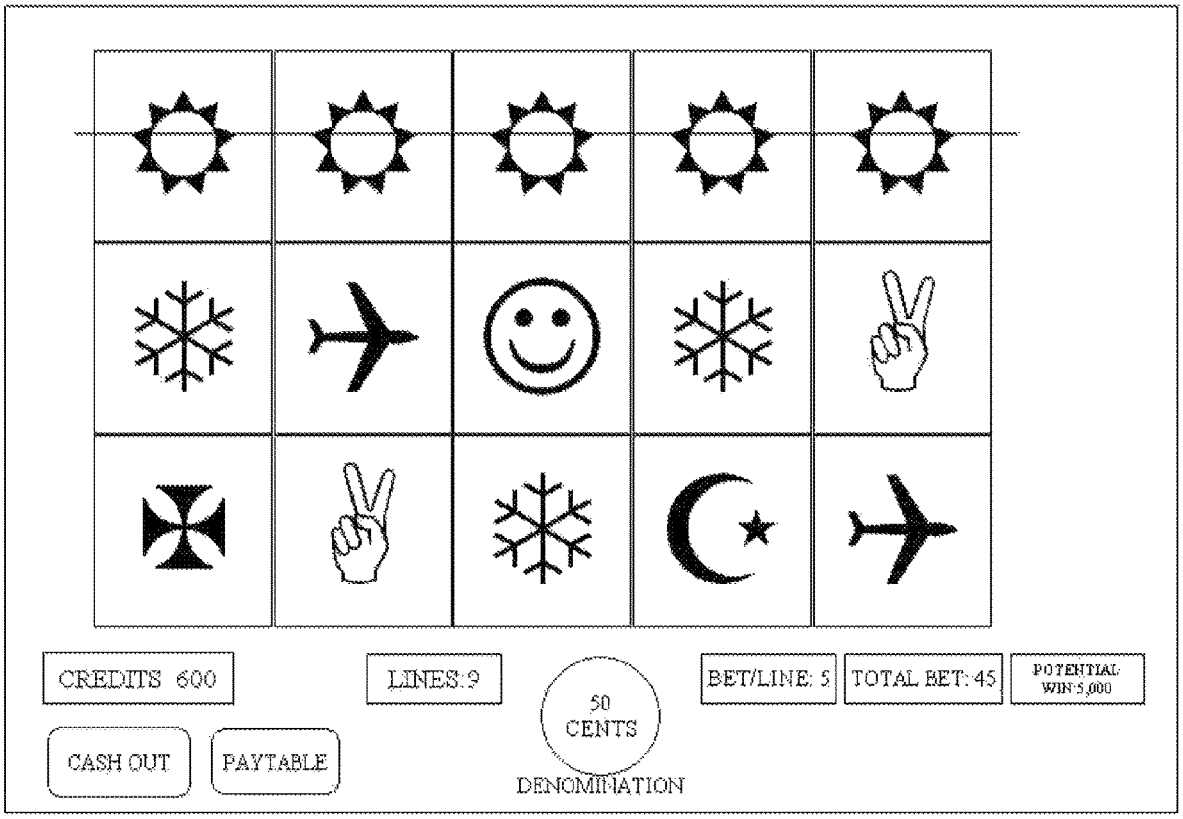
FIG. 3 is a drawing of a slot machine game after the spin is complete, according to an embodiment.

FIG. 3 is a drawing of a slot machine game after the spin is complete, according to an embodiment.

After the reels spin, the come to a stop as illustrated in FIG. 3. Here the player has bet on all nine paylines (see FIG. 11), with five coins bet per line. The player has achieved one winning payout (line 1, FIG. 11) for a potential win of $5,000 ($1,000 times 5 coins bet per line). However, unlike a traditional slot machine game, the player is not yet awarded this (or any award). The player will play a skill game in order to earn as much of the $5,000 as possible.

A reveal list button 300 is displayed (this button can be displayed at all times during the game or just some of the time (e.g., when the machine is waiting for player action). When pressed, the reveal list button 300 will bring up a reveal list as illustrated in FIGS. 17-18. The reveal list is displayed to the player for free without requiring the player to pay anything to see the reveal list. The reveal list can be displayed as many times as the player wants at any point in the game play.

Figure 4:
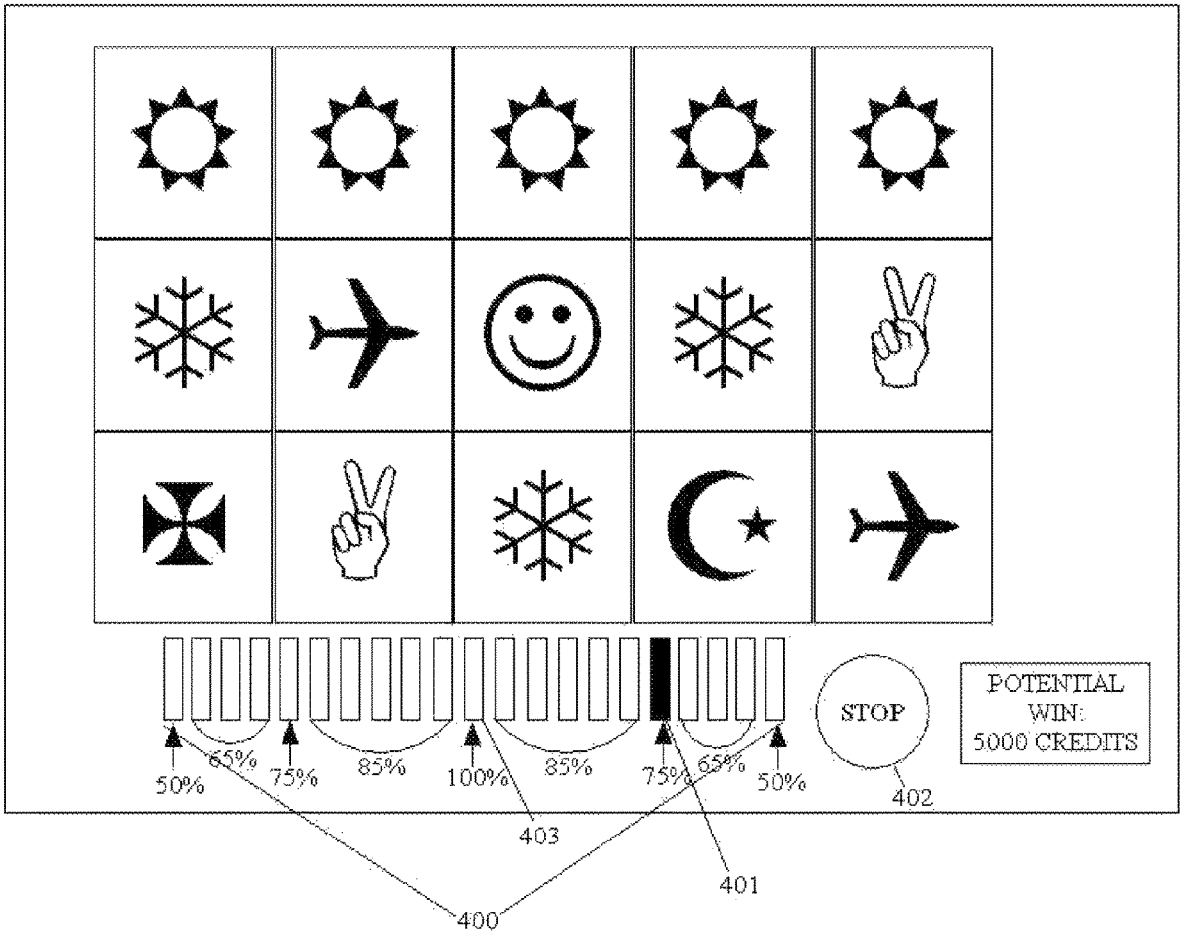
FIG. 4 is a drawing of a slot machine game when a skill game is initiated, according to an embodiment.

FIG. 4 is a drawing of a slot machine game when a skill game is initiated, according to an embodiment.

A skill meter 400 is displayed which shows 21 discrete bars (although any number of bars can be used). One of these bars is a highlighted bar 401. The highlighted bar 401 appears in a different color (or shape, etc.) than the other bars.

The highlighted bar will move (animate) back and forth in a "ping pong" fashion from left to right back to left again, etc. The highlighted bar will move to the right and when it reaches the rightmost bar it will change direction and move to the left and when it reaches the leftmost bar it will change direction again and move back to the right. This animation will repeat indefinitely until the player presses the stop button 402. Typically, the highlighted bar will remain highlighted for a fixed amount of time (e.g., two tenths of a second) before the highlighted bar becomes the next bar. When the stop button 402 is pressed, the highlighted bar no longer will move and will remain "frozen" so the player can see where the highlighted bar is.

It is the player's goal to press the stop button 402 (by touching the stop button 402 on a touch screen, or pressing a physical button on the device, or clicking a mouse, etc.) when the highlighted bar is the center bar 403. If the player presses the stop button 402 when the highlighted button is the center bar 403 then the player wins 100% of the potential award. The location of the highlighted bar when the player presses the stop button 403 determines the percentage of the potential award that the player wins (the actual award). Typically, the further away from the center that the highlighted bar is when the stop button 402 is pressed the lower the percentage of the potential award that the player gets (the actual award)

Thus, a player with quick reflexes (and good hand-eye coordination) may be able to stop the highlighted bar at or close to the center (winning the biggest percentage of the potential award), while a player with slow reflexes (and poor hand/eye coordination) will fare worse than the skilled player.

Table I below illustrates the different possible locations of the highlighted bar (after the stop button is pressed) and the respective percentage of the potential award the player would win (actual award) at that position. Of course, this represents merely one example and it can be appreciated that other configurations of payout percentages and their respective locations/ranges of the bars can be used. In addition, in an alternate embodiment, certain location(s) of the highlighted bar could pay more than 100% of the potential award. In addition to a linear bar, other shapes of the moving bar could be used as well (e.g., circle, etc.) While not pictured in Table I, certain position(s) could have a 0 award (the player wins nothing), e.g., position 1 has an award of 0 instead of 50%.

TABLE I

| position | % of potential award |
|---|---|
| 1 | 50 |
| 21 | |
| 2-4 | 65 |
| 18-20 | |
| 5 | 75 |
| 17 | |

TABLE I-continued

| position | % of potential award |
|---|---|
| 6-10 | 85 |
| 12-16 | |
| 11 | 100 |

Figure 5:
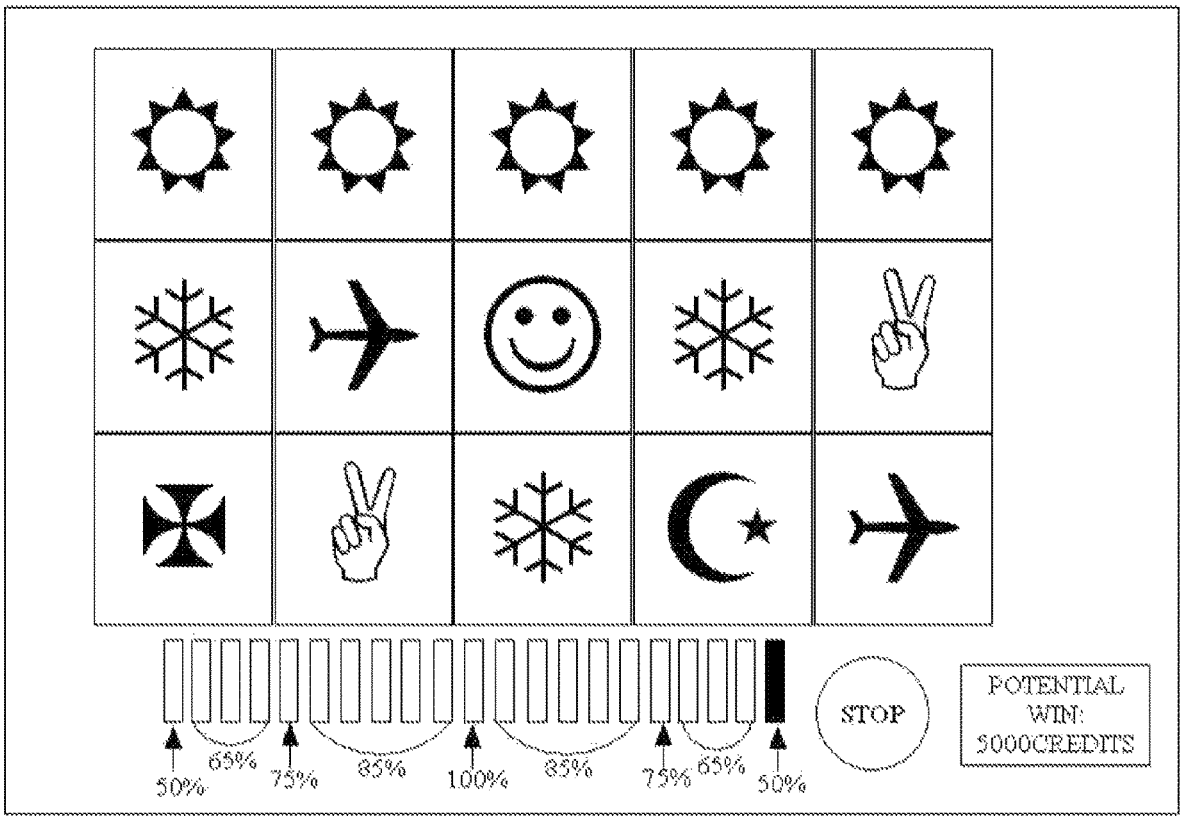
FIG. 5 is a drawing of a slot machine game when an animated bar has moved to the right, according to an embodiment.

FIG. 5 is a drawing of a slot machine game when an animated bar has moved to the right, according to an embodiment.

The highlighted bar has moved to the rightmost position on the skill meter and then will reverse direction and start moving again to the left. It is noted that while FIG. 4 showed the highlighted bar at position 17 and FIG. 5 shows the highlighted bar at position 21, the computer would also show the highlighted bar moving through positions 18-20 as well, but figures showing the highlighted bar at these positions (and all the other unillustrated positions as well) are omitted for simplicity. The player can press the stop button when the highlighted bar is at any of the possible positions.

Figure 6:
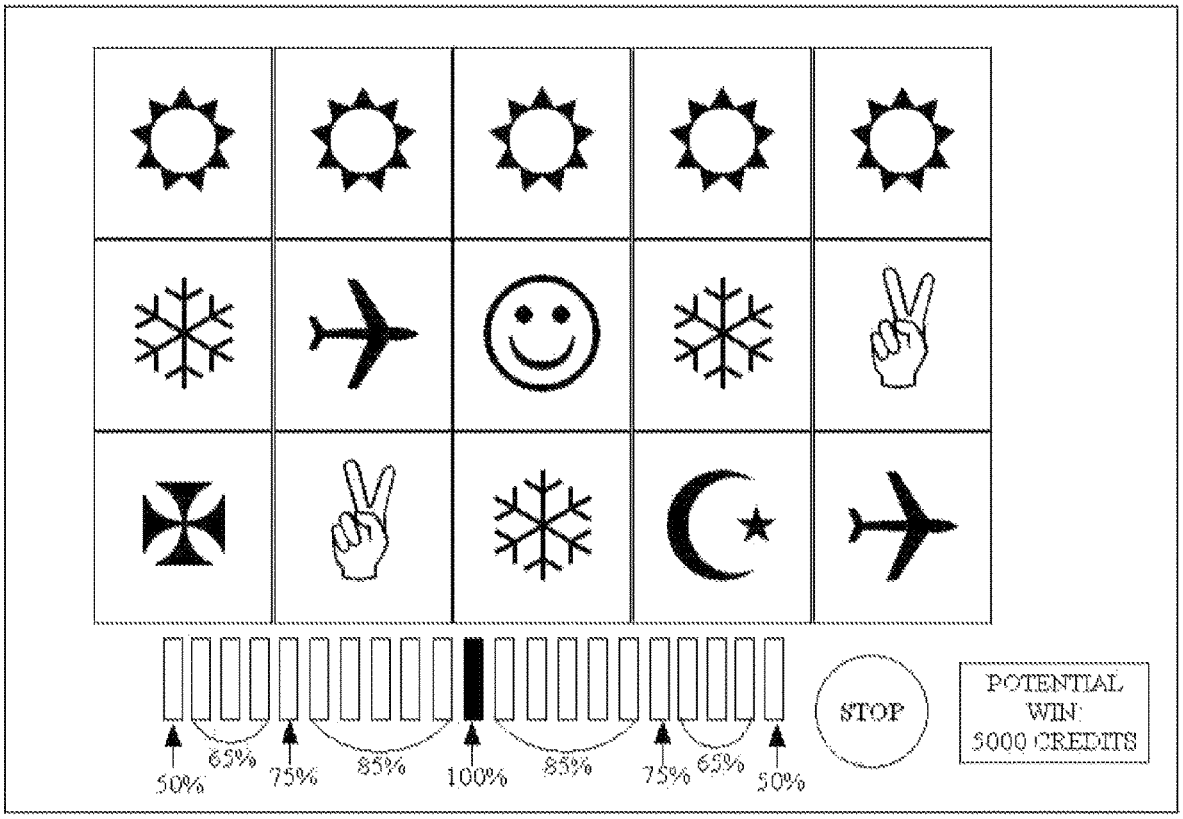
FIG. 6 is a drawing of a slot machine game when the animated bar has moved to the left, according to an embodiment.

FIG. 6 is a drawing of a slot machine game when the animated bar has moved to the left, according to an embodiment.

In FIG. 6, the bar is now moving to the left. If the player were able to press the stop button at this position (where the highlighted bar is in the center), the player would win an actual award of 100% of the potential award ($5,000). Of course, this is the player's goal.

Figure 7:
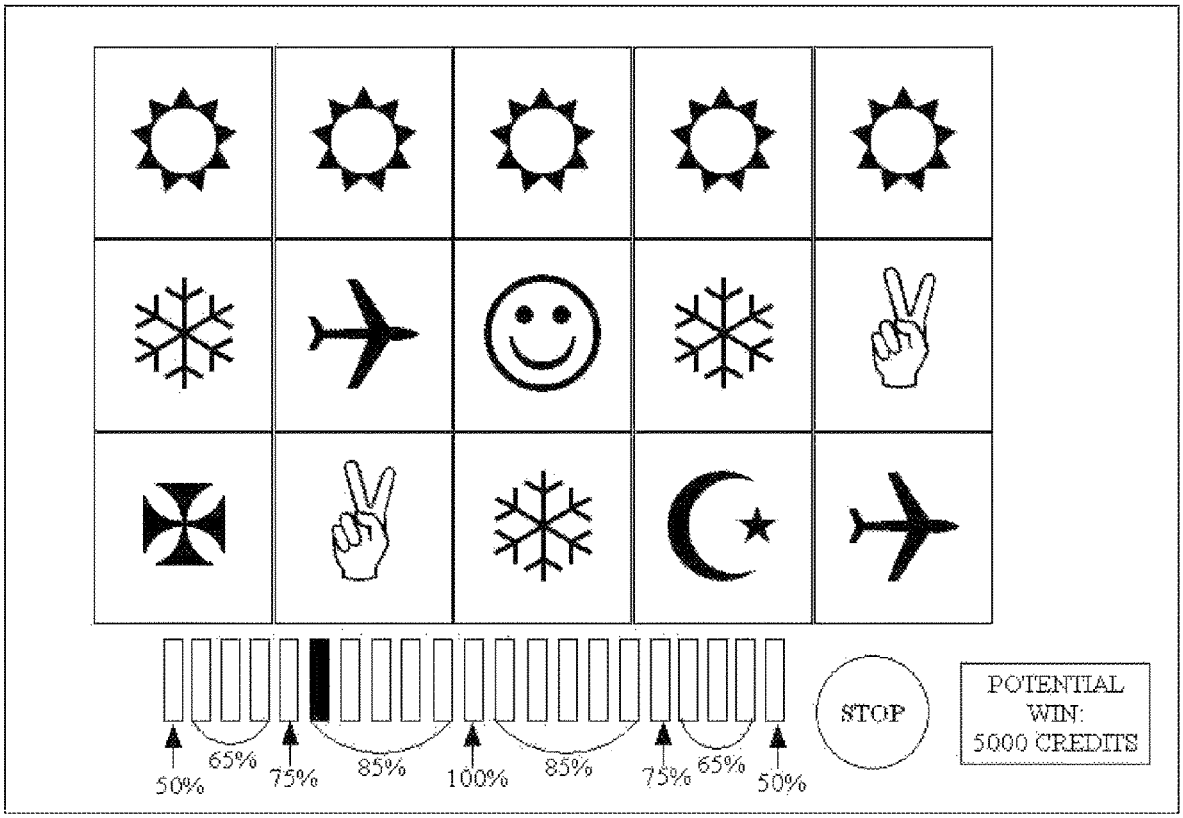
FIG. 7 is a drawing of a slot machine game when the animated bar has moved further to the left, according to an embodiment.

FIG. 7 is a drawing of a slot machine game when the animated bar has moved further to the left, according to an embodiment.

FIG. 7 shows the highlighted bar continuing to move to the left. As stated above, the computer would show the highlighted bar moving through each of the positions, but drawings showing the highlighted bar at each individual position is omitted for simplicity.

Figure 8:
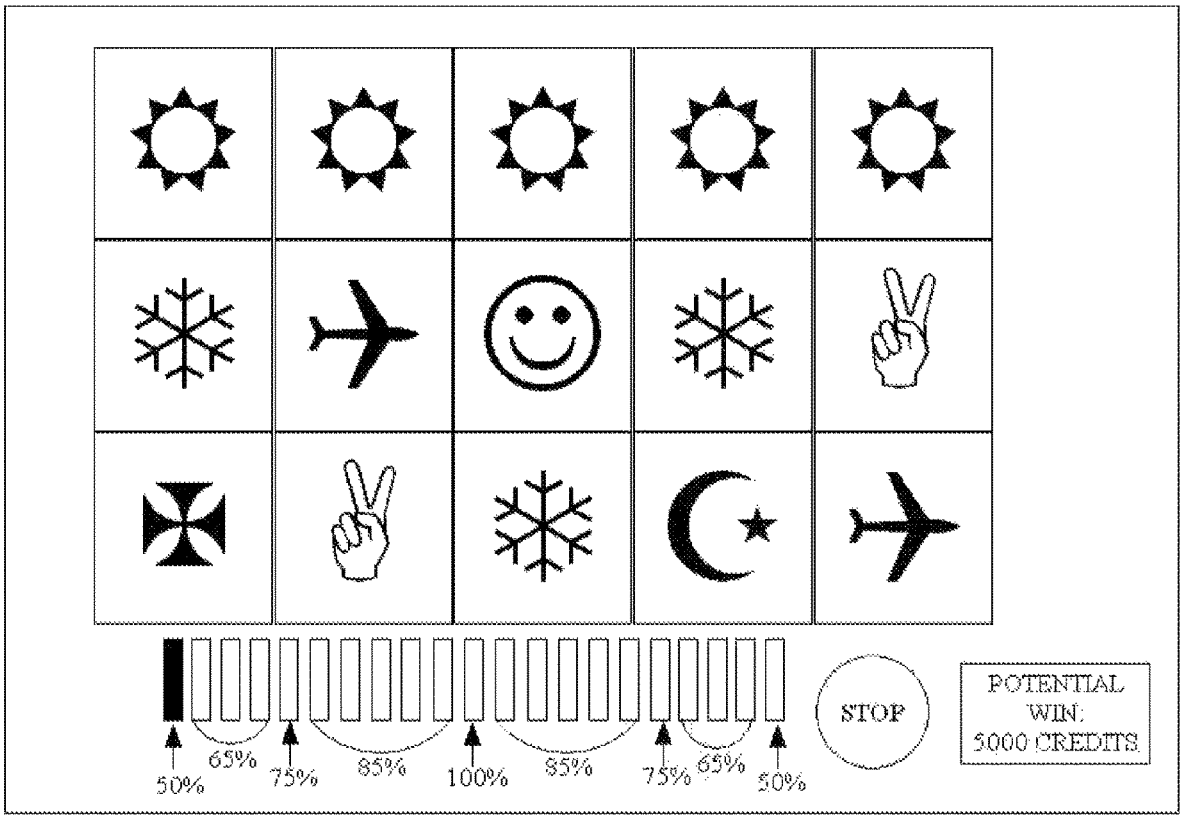
FIG. 8 is a drawing of a slot machine game when the animated bar has moved to the leftmost position, according to an embodiment.

FIG. 8 is a drawing of a slot machine game when the animated bar has moved to the leftmost position, according to an embodiment.

The highlighted bar is now at the leftmost position. The player would not wish to press the stop button at this position as the player would win the lowest possible award (50% of the potential award or $2,500). In an embodiment, stopping the highlighted bar in the wrong position could result in zero award.

Figure 9:
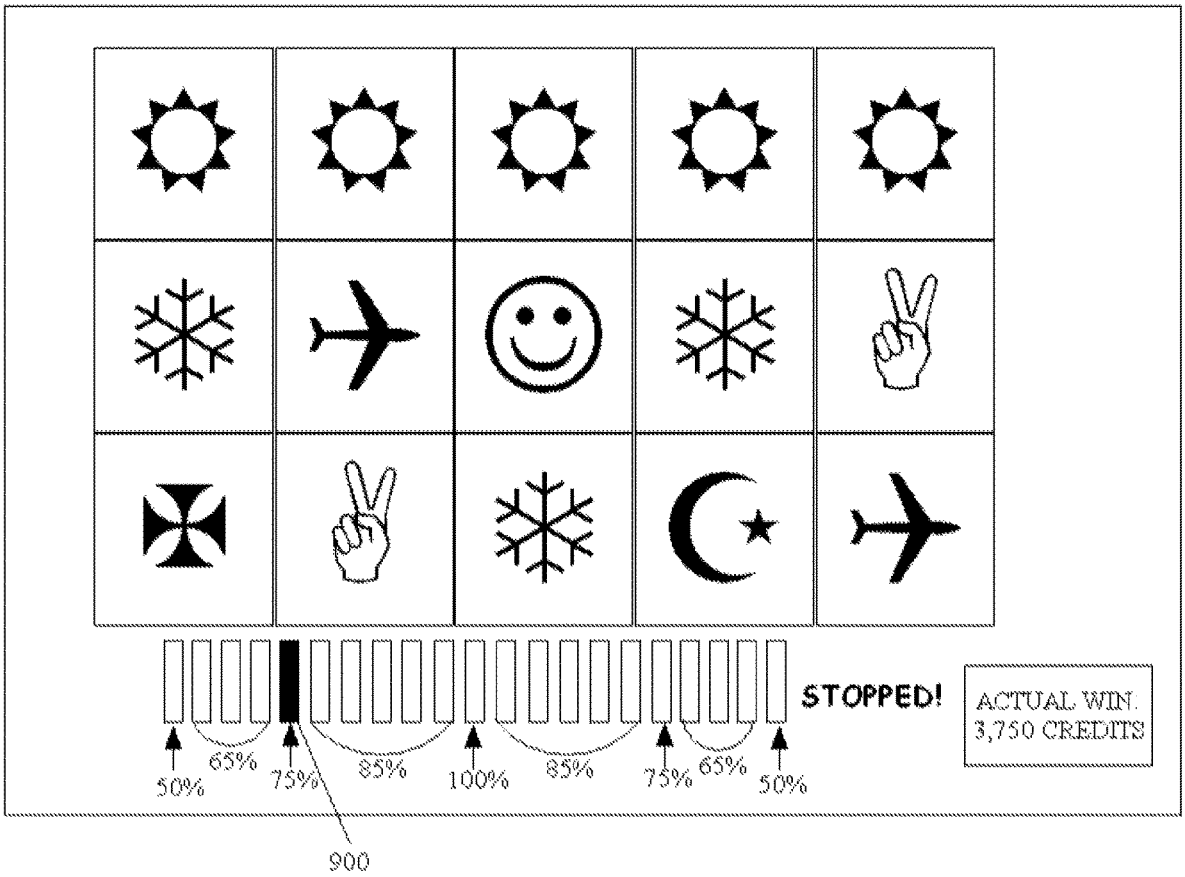
FIG. 9 is a drawing of a slot machine game when the animated bar is stopped by the player, according to an embodiment.

FIG. 9 is a drawing of a slot machine game when the animated bar is stopped by the player, according to an embodiment.

The highlighted bar is at the fifth position when the player presses the stop button. Once the stop button is pressed, the stop button is removed and can no longer be pressed. The highlighted bar 900 now freezes in position and can also be considered a frozen bar 900 (since it will no longer move). Since the highlighted (frozen) bar is in position five, according to Table I the player wins 75% of the potential award (5,000) or 3,750 credits. This screen can remain until the player presses the screen (or other action) so that the player can inspect the skill meter and understand what has happened.

Figure 10:
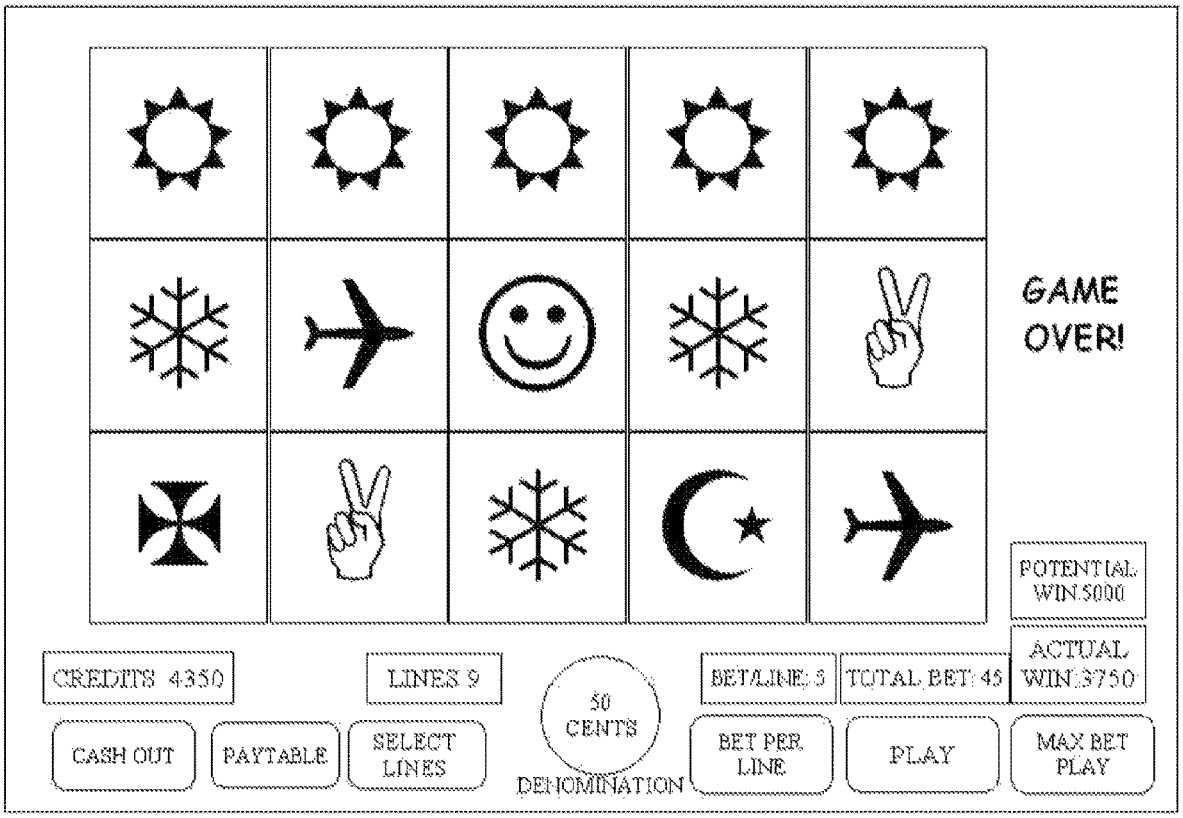
FIG. 10 is a drawing of a slot machine game after the game is completed, according to an embodiment.

FIG. 10 is a drawing of a slot machine game after the game is completed, according to an embodiment.

In FIG. 10, the game is over and the player's actual award of 3,750 credits is added to the credit meter. The player can now play a new game by pressing the "play" button (which would use the paylines/bet amount from the prior spin) or the "max bet play" button (which automatically bets the maximum bet and paylines), which would spin the reels again.

In an alternate embodiment, instead of the player trying to stop the highlighted bar in the center of the skill meter, other configurations of the skill meter can be used, for example one wherein the player tries to stop the highlighted bar in the rightmost or leftmost (or any other) bar. Table II below represents a configuration wherein the player tries to stop the highlighted bar at the rightmost position (bar). In this configuration, the skill meter has 30 bars (numbered 1 to 30 from the left) wherein the player will of course try to stop the highlighted/frozen bar on the rightmost (thirtieth) bar. Note that in this example, the player can earn an actual award of 101% of the potential award if the player stops the highlighted bar in the rightmost ($30^{th}$) position (in other words the frozen bar is in position 30).

TABLE II

| position | % of potential award |
|---|---|
| 1-5 | 50 |
| 6-15 | 65 |
| 16-25 | 75 |
| 26-28 | 85 |
| 29 | 100 |
| 30 | 101 |

It is further noted that the skill meter is not limited to a horizontal moving highlighted bar but alternatively can be presented as a set of vertical bars in which the highlighted bar moves up and down vertically (or even diagonally). As an alternative to using bars, any other type of icon can be used as well.

FIG. 11 is a drawing of exemplary rules for a slot game, according to an embodiment.

Shown are nine paylines for the game (the player is free to bet on 1-9 paylines at the player's option). Of course other numbers of paylines can be used (from 1-243 paylines), and the symbols forming each payline can be chosen by the game designers using any desired configuration.

Also shown is a paytable which can be used to determine awards for each active payline (payline the player has bet on). Payouts are typically paid from left to right, in other words, the leftmost symbol must start a combination. Of course, these payouts are just illustrated as an example, and any other set of payouts can be used. No representation is made that the payouts presented herein are mathematically proper.

Furthermore, the application of the skill element as described herein is not limited to a five reel slot game but can be applied to any type of slot game (e.g., 3 reel, 3×3 grid, etc.) or non-slot game (video poker) or virtually any type of wagering game at all. In addition, the present inventive concept is not limited to using the skill element described herein (the skill meter) and other mechanisms of introducing player skill can be used as well. Such mechanisms would presented an animated icon in which the player would be required to press one or more buttons (real of virtual) in order to effectuate a game action on the game which has a cause/effect relationship of determining a final state of the skill element which then determines a percentage of a potential award to actually award to the player.

Figure 12:
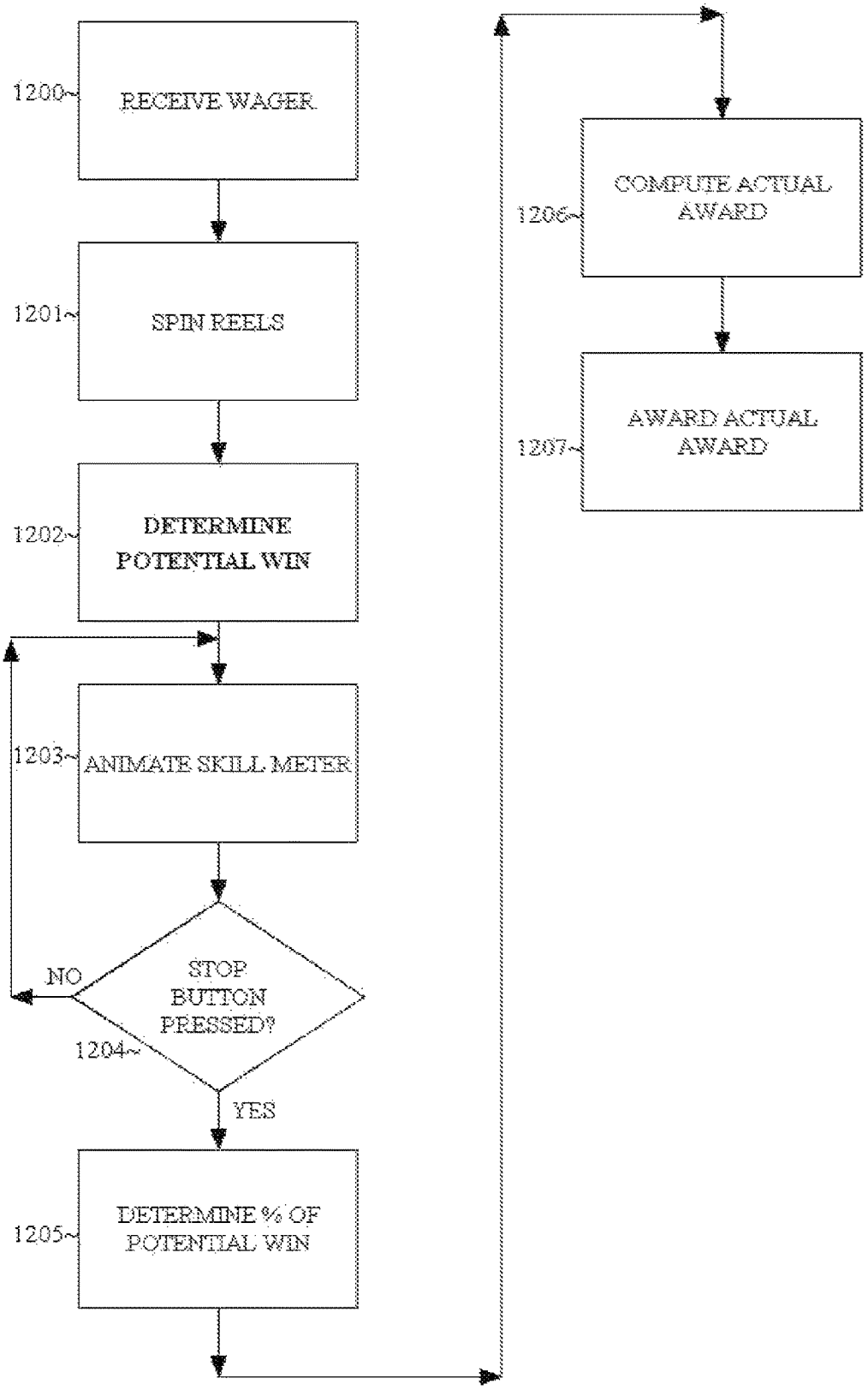
FIG. 12 is a flowchart illustrating an exemplary method of implementing a slot machine game incorporating a skill element, according to an embodiment.

FIG. 12 is a flowchart illustrating an exemplary method of implementing a slot machine game incorporating a skill element, according to an embodiment.

The method can begin with operation 1200, which receives a wager from a player. This can be done as known in the art. Typically, the player first funds the machine by providing a source of credits to the machine which the player converts to credits. The source of credits can be cash, electronic funds, a card which contains sweepstakes points, a cashless ticket/voucher, or any other known method.

If the wager made is in the form of Sweepstakes points, then a respective number of sweepstakes points (instead of credits) are deducted from a player's account. The account can be stored in an electronic database which stores a player's respective number of available sweepstakes points. When sweepstakes points are used, winnings are not in the form of sweepstakes points but credits which can be exchanged by the player for cash (or prizes). Thus, in this embodiment, there are two quantities (Sweepstakes points which are used for wagering and credits which are used for redemption). The player pays Sweepstakes points to play but wins awards in the form of credits (or win points, or other points, etc.). This is different to the traditional method of wagering described herein in which wagers are made using credits and awards are paid using credits. The player is always free to redeem their win points (or points) at any time, which can be redeemed in the form of a store coupon (at the store where the game machine the player is playing is located, a gift card, cash, etc.) For example, the player can start with 1000 Sweepstakes points and each spin on the slot game costs 10 Sweepstake points. When the player wins a game the player wins win points (not Sweepstakes points). When the player has used up all of his/her Sweepstakes points, the player cannot play any further (without getting more Sweepstakes points such as by purchasing more phone time) and the player cannot use his/her win points to play. But the win points can be redeemed for prizes (e.g., gift cards, cash, merchandise, etc.)

Once the machine has credits, the player makes a wager by indicating (using buttons) how much the player wishes to bet. When the player wants to finally place the wager, the player issues a command (e.g., presses a button) which places the wager (and the wager amount is then deducted from the player's credit meter).

From operation 1200, the method proceeds to operation 1201, which spins the reels. Typically, the electronic output device will display a "reel blur" indicating that the reels are spinning. The reels will automatically stop at random positions after typically 1-2 second of spinning.

From operation 1201, the method proceeds to operation 1202, which computes a potential win (or potential award). The potential win is computed as the sum of each award for each active payline. Each award is determined by comparing the symbols falling under that respective payline against a paytable (see FIG. 11) to determine a respective payout, and the award is determined by multiplying the payout by the number of credits (coins) bet per payline. Combinations which are not listed as winning combinations are losing combinations, and paylines with losing combinations have an award amount of zero. In an embodiment, as described herein the potential win/award is determined based on a reveal from a finite pool, in other words it may have been determined randomly at an earlier time (when the finite pool was generated) but at the current time the potential win/award is merely electronically retrieved from the finite pool.

The potential award is displayed but not yet awarded to the player as the player must enter the skill element (operations 1203-1206) in order to determine the actual award (which is a function of the potential award).

From operation 1202, the method proceeds to operation 1203, which moves the highlighted bar one position to the next position. If the highlighted bar reaches the end of the skill meter, then the direction of the highlighted bar will reverse and proceed in the opposite direction. Technically, the highlighted bar is moved by highlighted the next position and removing the highlight for the current position. The current position now becomes the next position.

From operation 1203, the method proceeds to operation 104, which determines if the stop button is pressed. If not, the method returns to operation 1203. If the stop button is pressed, then the method proceeds to operation 1205. It is noted that in an optimal embodiment, after a predetermined and excessive amount of time has passed before the player has pressed the stop button (e.g., 10 minutes), the game can automatically stop the bar (either at a random time or to award the minimum percentage possible) in order to avoid an infinite loop.

In operations 1203-1204, the highlighted bar is moved back and forth repeatedly until the stop button is pressed. The speed of the moving bar is fast enough so that it would not be easy for the typical person to stop it in a particular location. However, the speed is slow enough that the average player's mechanical skill would still give the player an advantage in stopping the highlighted bar in the desired location (or a position near the desired location) as compared to the bar stopping in a purely random location. The speed the highlighted bar moves is constant, although in an alternative embodiment the speed can change. As the player improves their hand-eye coordination, the potential to stop the indicator at the ultimate stop position improves, thus giving the skilled player a higher potential to win than the lesser skilled player.

From operation 1204, if the stop button is pressed the method proceeds to operation 1205, which determines a percentage of the potential win to award the player. This is determined as a function of the location of the highlighted (now frozen) bar. A table such as that illustrated in Table I or II (or any other configuration) can be used.

From operation 1205, the method proceeds to operation 1206, which computes the actual award to award the player. Once the percentage of the potential award is determined from operation 1205, this percentage is applied to the potential award to determine the actual award (e.g., if the potential award is 100 credits and the percentage is 50%, then the actual award is 50 credits).

From operation 1206, the method proceeds to operation 1207, which awards the actual award (computed in operation 1206) to the player. This typically entails adding the actual award (which is also displayed to the player) to the player's credit meter.

Figure 13:
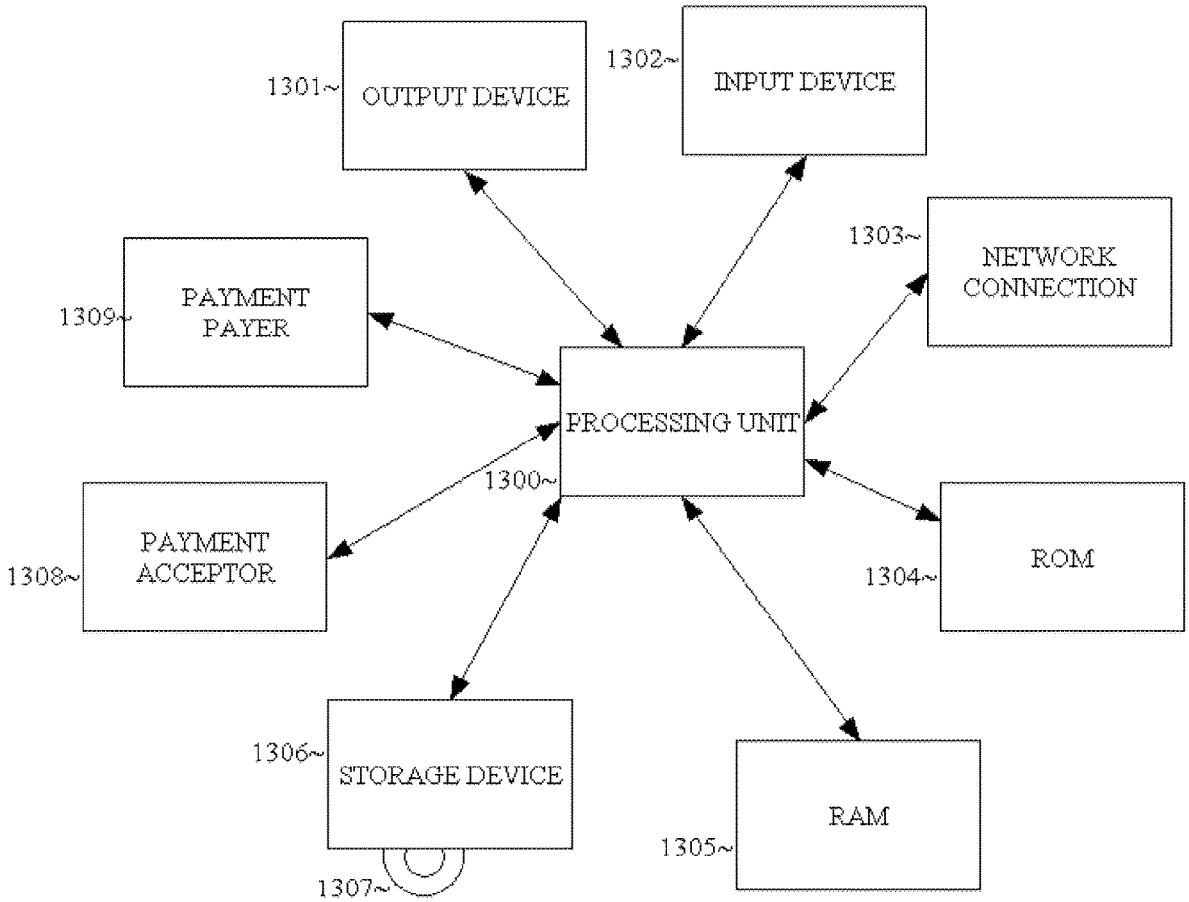
FIG. 13 is a block diagram illustrating exemplary hardware that can be used to implement the present invention, according to an embodiment.

FIG. 13 is a block diagram illustrating exemplary hardware that can be used to implement the present invention on an electronic gaming device, according to an embodiment.

A processing unit, such as a microprocessor and associated structure (e.g., bus, cache, etc.), is connected to an output device 1301 (e.g., LCD, CRT, touch-screen, etc.) and an input device 1302 (e.g., touch-screen, keyboard, mouse, physical buttons, etc.) The processing unit 1300 can be configured and programmed to execute instructions that will implement any of the methods described herein on the electronic device. The processing unit 1300 can also be connected to a network connection 1303 which can connect the system to a computer communications network (e.g., Internet, LAN, WAN, etc.) The processing unit 1300 can also be connected to a ROM 1304 and a RAM 1305 and a storage device 1306 (e.g., BLU-RAY drive, hard disk drive, floppy disk drive, CD-ROM drive, etc.) and a non-transitory computer readable storage medium 1307 (e.g., BLU-RAY disc, CD-ROM, EPROM, etc.) The computer readable storage medium 1307 can store instructions and assets in order to direct the processing unit 1300 to implement the methods described herein. The processing unit 1300 can also be connected to a payment acceptor 1308 which accepts consideration from the player in order to pay for the spins of the slot game.

The payment acceptor 1308 can be a bill acceptor, an electronic payment acceptor, a ticket (cashless voucher) reader, etc. The payment acceptor 1308 can also be a card reader which can read an electronic card which has an account number encoded on it, the account associated with the account number contains a respective number of Sweepstakes points which can be used to pay for the spins.

Also connected to the processing unit 1300 is a payment payer 1309 which, upon a cashout request by the player, issues the player actual payment for the amount of credits the player currently possesses. The payment payer can be a cash payment mechanism which actually dispenses cash or coins, or a ticket dispenser which dispenses a voucher which can be redeemed (at a cashier or clerk at the location) by the player for a respective amount of cash.

It is further noted that FIG. 13 describes components to the system however it is not necessary that all components be actually directly connected to the processing unit 1300. It is sufficient that the components are operationally connected (can work together with the processing unit) in order to effectuate their functions. In addition, instead of a single processing unit 1300, multiple processing units (not pictured) can be implemented.

The methods described herein can be implemented by any type of gaming system, e.g., a slot machine (video or mechanical) in a casino, a computer (personal computer or portable device) playing at an online casino over the Internet, and a game promotion/Sweepstakes system that uses Sweepstakes points to play, etc.

Figure 14:
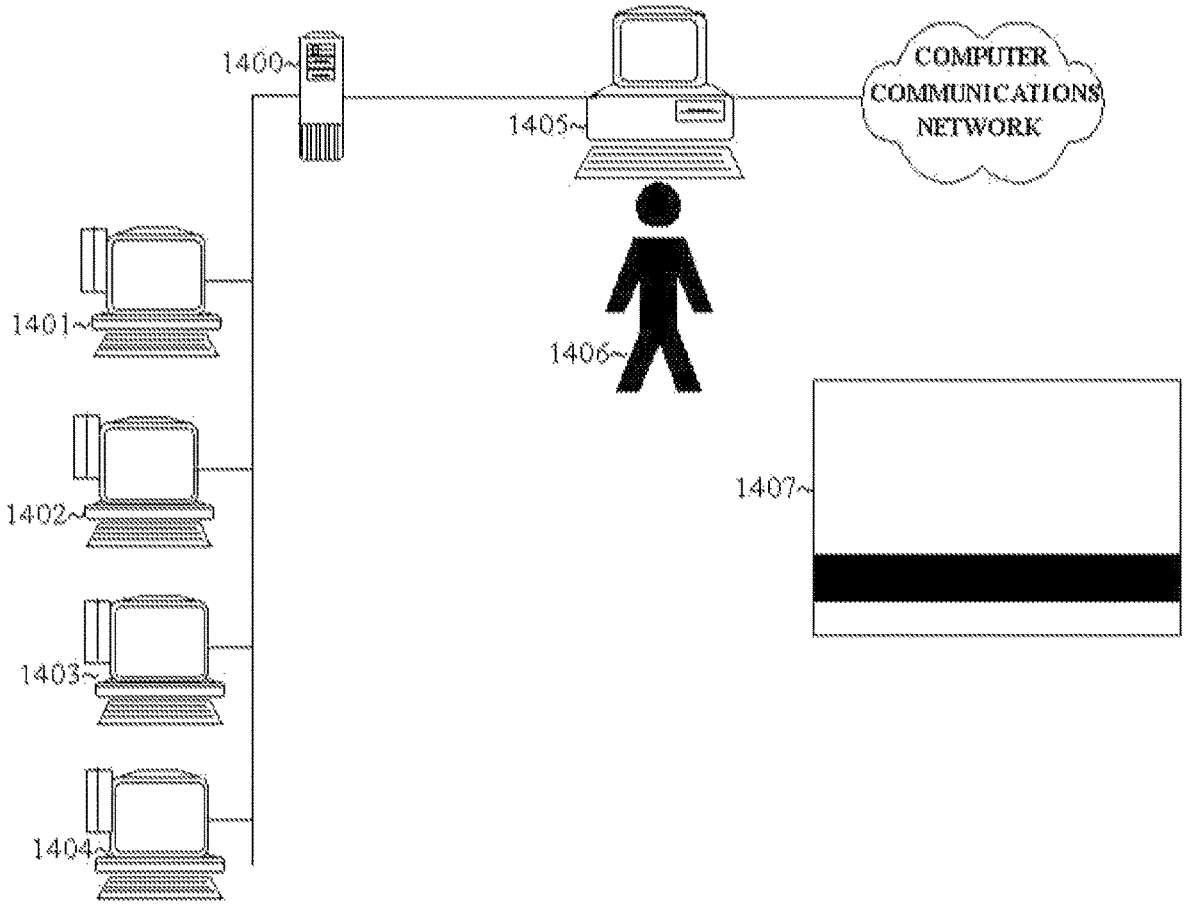
FIG. 14 is a block diagram illustrating hardware that can be used to implement a game on a Sweepstakes system, according to an embodiment.

FIG. 14 is a block diagram illustrating hardware that can be used to implement a game on a Sweepstakes system, according to an embodiment. Slot machine games and online casinos are well known in the art. Lesser known is the Sweepstakes parlor paradigm.

A "Sweepstakes parlor" can offer the game herein and can be implemented as follows. A server 1400 can distribute a finite pool of prizes across a number of winning and non-winning "tickets." This can be done periodically (e.g., every day before play is allowed). For example, a Sweepstakes distribution can be predefined as allocating 100 tickets, with 90 non-winning tickets (no award), 9 winning $5 and 1 winning $50. The winners/non-winners are randomized such that players cannot determine whether they are a winner/non-winners without actually playing the system.

A player (not pictured) can purchase a card 1407 (which can have for example phone time or other valuable goods or services) for cash from an attendant 1406. The attendant 1406 will activate the card 1407 using a workstation 1405 which can be connected to a computer communications network such as the Internet. In an embodiment the workstation 1405 (and the game terminals) are not connected to the Internet but only a local communications network (closed loop). The card in addition to having telephone time (or other value) can come with free Sweepstakes points (e.g., 100 points, each point good for one free spin of the game). The player can also purchase additional phone time (using cash, credit card, etc.) at the machine the player is currently playing at (see FIG. 13) which will award the player additional free Sweepstakes points to play the game with.

The player could then take the card 1407 to one of a plurality of game terminals 1401, 1402, 1403, 1404 which are in communication with the server 1400. Each game terminal has a card reader wherein the player can enter or swipe the card info 1407 so that the terminal can identify the account associated with the card 1407 and access the server 1400 to determine how many Sweepstakes points the card 1407 has associated with it. Sweepstakes points cannot be converted directly into cash but can be used to play the game described herein (or any other game) in which if the player wins an award the award is in the form of credits which can then be converted into cash (or prizes).

When the player has entered the card info 1407 and the system determines that the card has Sweepstakes points, the player can pay a predetermined number of sweepstakes points for each spin (play) of the game. That number of sweepstakes points would be deducted from the account associated with the card 1407 and the game begins (this is associated with operation 1200). In this embodiment, no "wager" is really made, instead Sweepstakes points are used to play the game and reveal the game outcome.

The potential win (in operation 1202) is determined by using the finite pool of prizes and selecting one such prize at random or sequentially. The actual symbols displayed on the game can be reverse mapped from the prize to determine which symbols to actually display.

When the player is done playing in the Sweepstakes embodiment, then the player can return to the attendant 1406 who can verify (using the card 1407) how many credits the player has won. The attendant 1406 can then issue the player cash in exchange for the credits (e.g., $0.01 for each credit), a prize based on the number of credits, or other award.

In this manner, the player is not really "wagering," but can instead purchase a phone card (or other item or service), receive free sweepstakes points, and then play the game at a terminal (typically on-site although they can also be located off-site) and win credits. The credits can then be exchanged on-site for cash.

Figure 15A:
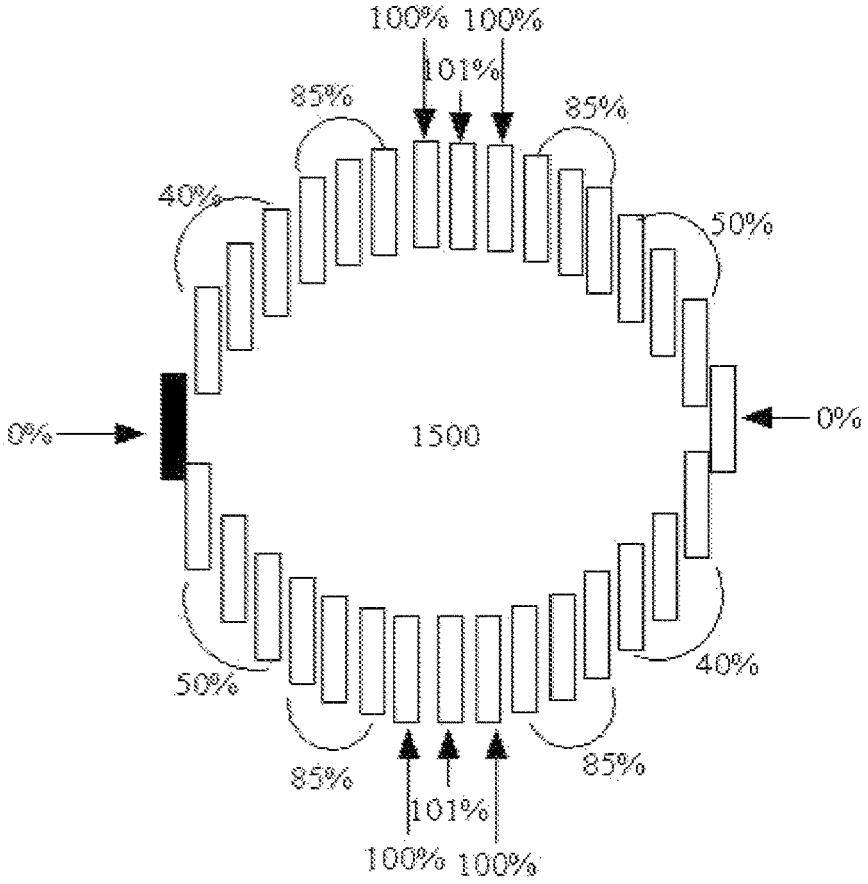
FIG. 15A is a figure illustrating a non-linear arrangement of bars, according to an embodiment.

FIG. 15A is a figure illustrating a non-linear arrangement of bars, according to an embodiment.

Instead of the linear arrangement of bars illustrated in FIGS. 4-9, a non-linear arrangement can be used as well. In FIG. 15, the moving highlighted bar continuously moves around the circular arrangement 1500 (clockwise or counter clockwise) until the player presses the "stop" button and stops the moving bar (which becomes a frozen bar). The percentage associated with the frozen bar is the percentage of the potential award that the player wins. In this example, the highlighted bar would pay 0% (nothing) if the stop button were pressed at this location.

Other non-linear arrangements of bars can be used as well, such as ovals, half-circles, zig-zags, etc.

Instead of applying percentages, other relationships can be assigned to the bars to determine the actual award from the potential award.

Figure 15B:
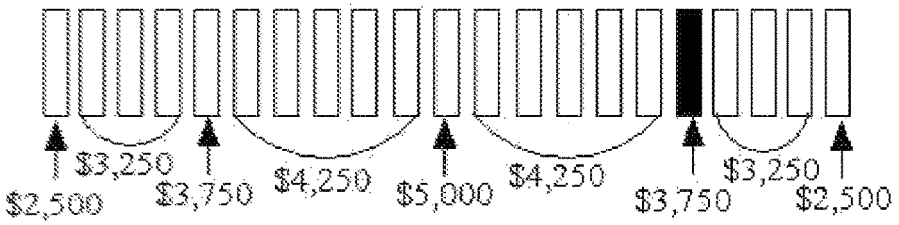
FIG. 15B is a drawing illustrating assigning prizes onto the bars, according to an embodiment.

FIG. 15B is a drawing illustrating assigning prizes directly onto the bars.

The actual awards can be displayed alongside the moving bar and so percentages do not even have to be displayed. For example, instead of displaying the percentages alongside the moving bars (as illustrated in FIG. 4), the actual award (prizes, winnings) amounts can be displayed alongside their respective bars. FIG. 15B illustrates actual awards associated with the bars instead of the percentages illustrated in FIG. 4, but the prizes (winnings) displayed in FIG. 15B are the percentages from FIG. 4 applied to a $5,000 potential award. In other words the percentages are directly applied to the potential award and directly displayed on the bars of the skill meter, thus the end result would be the same. In FIG. 15B, the frozen bar (since the player pressed the stop button) is at a bar where the player wins $3,750 (the actual award). Thus, the skill meter as displayed in FIG. 15B can be used in place of the skill meter illustrated in FIGS. 4-9.

Alternatively, the set of awards displayed alongside the bars can be determined using other functions of the actual award besides percentages.

In a further embodiment, a player can play the game herein but results are not truly random. Instead, a set (e.g., a list) of predetermined results (actually potential wins) can be generated and stored (on a computer readable storage medium). The set of predetermined results can be very large, such as 1,000,000 (or any other number such as 1 to 1,000,000,000,000 can be used) potential wins (each potential win is a number which is used. Such a list can be generated for each machine (so each machine uses its own such set to get potential wins). Then each time the game is played, the next potential win the list is used to determine the result of the reel spin in each game). The potential win is reverse mapped so that the reels will spin and display a combination that has an award that matches the potential win (only awards that are possible to make using the paytable in use should be potential wins since other potential wins could not be reverse mapped to the reels). A pointer can be used which points to the current (or next) potential win that is to be used in the set (list). Each time a potential win is used, then the pointer advances to the next potential win in the sequence so that once can be used.

The game machine would continue to use results from the set of potential wins even after the machine is powered off (e.g., at the end of the day) and restarted (e.g., at the beginning of a new day). Typically, the set of potential wins would continuously be used over a long period of time, until the set has been depleted (or manual intervention).

When the entire set of potential wins is used, then a new set of potential wins can be generated and used again. Each potential win in the set should only be used once. In some situations, an operator of the system can manually initiate a new set of potential wins to be generated and used again.

A reveal list is available to the player to view at any time, which can be displayed when the player presses a reveal list button (see FIG. 3). The reveal list will display the next X potential wins in the set being used (X can be 1, 2, 3, 5, 10, 50, 100, 1000, or any number from 1 to 10,000 or more). This list automatically updates upon each new game being played. Thus, by looking at the reveal list, a player can see the next 100 (or other X) potential wins that the player would get if the player played the next 100 games. The player is free to stop playing at any time if the player so chooses. For example, if the player sees little or no good results (potential wins) in the next X games, the player may decide to quit playing. On the other hand, if the player sees a large potential win coming up, the player would be motivated to continue playing in order to get that potential win. Note that when a player pays to play a game, the player is not paying to get a brand new outcome but to be awarded an outcome that the player can already see before paying anything to play.

In a simplest embodiment, if the reveal list shows only one potential upcoming win, then the game would work as follows. When the player first sits down to play, the player would already know the potential award of the game without having to pay anything. If the player does not wish to continue playing of course the player can walk away. The player can pay a cost (e.g., in Sweepstakes points) to play the next game, which will award the potential win the player already saw on the reveal list. Then the next outcome (another potential award) is revealed to the player but the player does not receive this newly revealed potential award until the next game where the player has to pay another entry cost (in Sweepstakes points, etc.) to play again and get this next potential award. Thus, the player will always know (if the player has checked the reveal list) what the next potential outcome is on the game before playing. Instead of being able to see only one upcoming outcome (potential award), the player can see X upcoming outcomes (potential awards) on a reveal list (as described herein), wherein X can be 1 or more.

Note that in an embodiment, the values stored in the set and revealed in the reveal list are potential wins which are used in the embodiment illustrated in FIG. 12. In another embodiment, a skill meter does not have to be used and instead of storing potential wins in the set, actual wins are stored (which are also shown in the reveal list) and the player can see the actual award the player would receive for the next X games. The actual award is reverse mapped (in the same manner as the potential award) but since there is no skill meter the actual award is what is awarded to the player.

Figure 16:
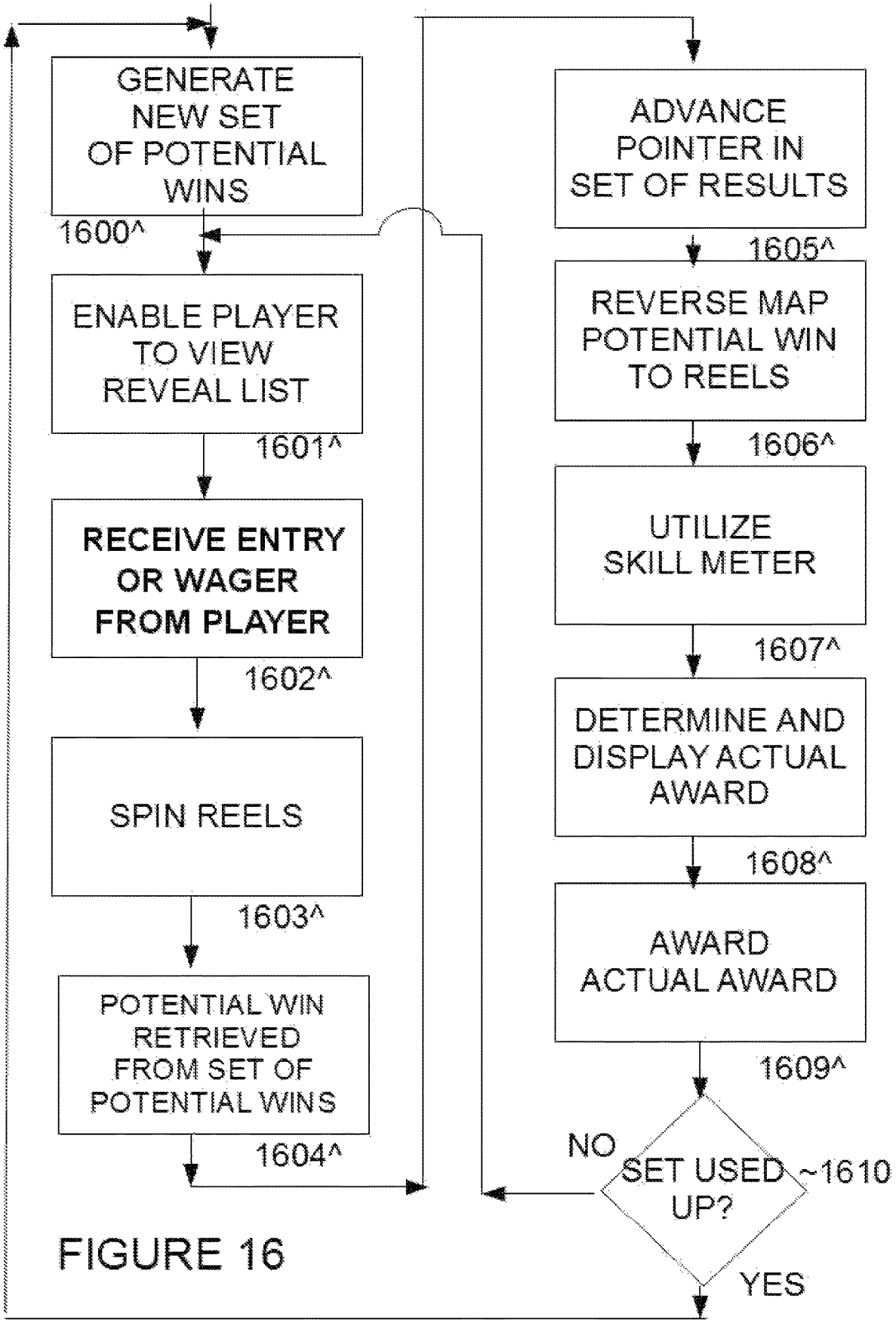
FIG. 16 is a flowchart illustrating an exemplary method of implementing a forward reveal feature, according to an embodiment.

FIG. 16 is a flowchart illustrating an exemplary method of implementing a forward reveal feature, according to an embodiment.

The method can begin with operation 1600, wherein a new set ("a finite pool") of potential wins is generated. This can be done by using a computer to randomly determine each potential win according to a mathematical model (e.g., random number, random draw from a predetermined set of possible draws, etc.) and repeating until the entire set is populated and stored. The set of potential wins is stored on a non-transitory computer readable storage medium such as a hard disk.

From operation 1600, the method proceeds to operation 1601, which enables a player to view a reveal list (which is a list of upcoming potential wins). A button can be displayed (see FIG. 3) which, when pressed, brings up the reveal list which shows the next X potential outcomes in the predetermined set. Note that the total number of outcomes in the entire predetermined set (T) is larger (typically much larger) than the number of potential outcomes displayed in the reveal list (X). This is because the outcomes displayed in the reveal list is a smaller subset of the entire set of outcomes that is used to retrieve outcomes from. For example, the predetermined set (generated in operation 1600) can have 1,000,000 outcomes (potential wins) while the reveal list only shows the next 100 outcomes (potential wins). After the game has been played 1,000,000 times, then a new predetermined set would have to be generated. When the game (assuming asset of 1,000,000 potential wins and the reveal shows only 100 of the upcoming potential wins) has reached the last 100 potential wins (e.g., the game played is 999, 901), the reveal list would only show all of the remaining potential wins (which would be less than 100). In another embodiment, if the end of the set is reached, a new set is automatically generated which is appended to the original set so there is no loss in continuity (e.g., there are always 100 (or any number X) of upcoming potential wins displayed).

From operation 1601, the method proceeds to operation 1602, which receives a wager from a player. The wager can be in the form of cash, credits, points, Sweepstakes points, etc. The player can indicate how much the player wishes to wager and then press a "spin" button to initiate a game. The wager can be in the form of an entry using points (such as Sweepstakes entry/points or other type of points) which is not a cash wager, the points used are deducted from the player's point balance when the game is initiated.

From operation 1602, the method proceeds to operation 1603, which spins the reels. The reels spin using animation and sound, etc. although the result of the spin is already known is pre-generated (taken from the set of potential wins).

From operation 1603, the method proceeds to operation 1604 which retrieves the next potential win in the set of potential wins (which will be used in operation 1606). There is a pointer pointing to the current entry in the set of potential wins that is to be used and this is the value that is retrieved. At this point, the player has not yet won anything.

From operation 1604, the method proceeds to operation 1605, which advances the pointed to the next value in the set of results (e.g., if the potential win used in operation 1604 was the 105,443 potential win in the set of 1,000,000, then the pointer advances to entry number 105,444).

From operation 1605, the method proceeds to operation 1606, which reverse maps the potential win (from operation 1604) and displays the spinning reels which spin and stop at the determined reel positions using computer animation. This means that whatever the potential win is that is going to be used, a payout from the paytable (and hence a combination if slot symbols to be displayed) is determined which results in that potential win. For example, from FIG. 11, if the potential win is 10,000, then the reel combination that results in a win of 10,000 is five flags. If more than one combination can be used which results in the same potential win then the combination used would be determined at random. For example, the five flags can appear on any active payline and the actual reel results used can be randomly chosen from any combination of reel positions which has the five flags on any payline to result in the 10,000 win. The total of all payouts on all paylines should total the potential win (e.g., if the potential win is 1,000 then this can also be achieved by five suns and two flags appearing simultaneously on the final reel positions on different paylines which would total 1,000). If a losing potential outcome is the used (0), then any random combination of reel positions can be used as long as that combination does not result in any award (i.e. it must have a total award of zero to match the losing potential outcome). Any losing potential outcome typically would not progress to the skill meter and would simply result in no award being awarded. alone one embodiment payouts are in the same units that the wager is made in (e.g., if the wager is in credits the payouts are in credits, if the wager is in dollars the payouts are in dollars, etc.), while in another embodiment payouts are in different units than the wager (e.g., payouts (also referred to as awards or actual awards) are in win points and the wagers are in Sweepstakes points, and the two are not interchangeable and cannot be converted between each other, although playing Sweepstakes points can earn win points). Note that the reels of the slot machine spin and stop giving the effect that they are spinning and stopping randomly (even though the stopping positions of the reels is determined from a reverse map from the predetermined potential award). This, displaying the animated spinning reels is for entertainment purposes. A table can be used of potential wins and reel positions (where the reels stop after a spin) so that the machine can determine from the potential win what reel positions the reels should stop at. The same potential win (potential award) from the finite pool can have multiple corresponding reel positions in the table, and if a potential win has more than one reel positions then the reel position that will be used in the game can be chosen at random.

From operation 1606, the method proceeds to operation 1607, which utilizes the skill meter. This is done as illustrated in operations 1203 to 1206, which uses the skill meter to determine an actual award from the potential award (outcome) and the player's mechanical operation of the skill meter. Note that if the potential award (potential win) from operation 1604 (and displayed in operation 1606) is zero then the game ends (because the player has not won anything) and thus there is no need to proceed to use the skill meter (since any percentage of 0 is still 0). Thus, if the potential award is zero then the reels will spin to a non-winning combination and the method proceeds to operation 1610 (skipping the skill meter implementations in operations 107-1609) where the player has the ability to play (and pay for) a new game.

Once the actual award is determined (in operation 1607 which determines the actual award as a function of the potential award), then the method proceeds to operation 1609 which awards the actual award. The individual game is now over and the player is free to walk away or play again (in operation 1602).

From operation 1609, the method proceeds to operation 1610 which determines whether the set of potential wins is used up (generated in operation 1600). If the set of potential wins is not used up, then the method proceeds to operation 1601 which continues retrieving results (potential outcomes) from this set. If in operation 1610 it is determined that the set is used up (e.g., all potential outcomes have been retrieved and used), then the method proceeds to operation 1600 which generates a new set of potential wins. An operator of the system can also manually direct the computer to implement operation 1600 and generate a new set of potential wins at any time.

Note that operation 1607 is optional, and the set of potential wins can instead be a set of actual wins (all potential wins as used herein can become actual wins) and thus the set of actual wins dictates the exact awards that the player will win each time the game is played.

FIG. 17 is a drawing of an exemplary screen shot of a forward reveal list, according to an embodiment.

The reveal list 1700 can be displayed on the machine by the player pressing a reveal list button 300 at any time. The reveal button can be pressed (displaying the reveal list) even if the player has not paid anything to play. The reveal list shows the upcoming potential wins. For example, there are 100 entries numbered 1 to 100. Entry number 1 (the one in the upper left) shows what the potential outcome will be for the very next game (spin) which will be zero. Thus, the player can make a wager and the next game will have an award of zero. The game after that will also have an award of zero. The game after that will also have an award of zero. The game after that will have a potential award of 50 (this can be mapped to a combination of symbols showing three planes (see FIG. 11) on a payline with no other winning combinations). The player would then get to use the skill meter which can then result in award of 50 or less (see the skill meter 400 in FIG. 4). In another embodiment, the award can also be greater than 50 (see the skill meter in FIG. 15A which has a top percentage of 101%). The player can note that 100 games out, there is an award of 1,000 waiting. If each game cost 1 credit, then this would be a profit and would be in the player's interest to play the next 100 games. If each game cost 50 credits, then the next 100 games would be at a net loss for the player (since 100 games times 50 credits equals 5,000 total credits played but there are only 2,050 in potential awards in the next 100 games) assuming that players don't typically get more than 100% of the potential awards. Many players will enjoy playing the game without worrying about checking the reveal list (or reveal screen) to see what lies ahead.

After the player plays the next game (entry 1 in reveal list 1700), then the reveal screen in FIG. 18 would be the next reveal screen to be shown.

FIG. 18 is a drawing of an exemplary screen shot of a successive forward reveal list, according to an embodiment.

As can be seen in successive reveal screen 1800, the potential outcomes have shifted down one after the last game has been played. The potential outcome of 50 is now only two games away and the potential outcome of 1,000 is now 99 games away. A new outcome at entry 100 is shown (0) which was not available in the reveal list 1700.

Note that the set of potential wins (or potential outcomes, potential results, etc.) is typically stored on a server (e.g., server 1400) which is a different computer from the game terminals (e.g., 1401, 1402, 1403, 1404, etc.) where players are actually playing the game. Each terminal displays the game but the outcomes are retrieved from the server. Note that each machine (e.g., game terminal) has its own respective set of potential outcomes and these are not shared between machines. Thus, if nobody plays a particular machine (e.g., terminal) all day, its reveal list will remain the same all day because no games have been played to advance that particular machine's pointer in its respective set of outcomes.

The reveal lists (such as those illustrated in FIGS. 17-18) can show actual awards (what the slot game would always actually award) or potential award (the award to which the skill meter is then applied to). If actual awards are shown, then the player would know exactly what the player would win for each of the successive 100 (or other number of outcomes shown). Of course, for each outcome earned, the player would have had to make a particular credit wager. Typically, the wager is fixed so that the player cannot raise or lower the wager, although in another embodiment the wager can be variable.

The predetermined set (of potential wins, actual wins, or any other value used by the game) is generated before the game is played by the player. The predetermined set is also considered a "finite pool" and can be used for Sweepstakes games.

Figure 19:
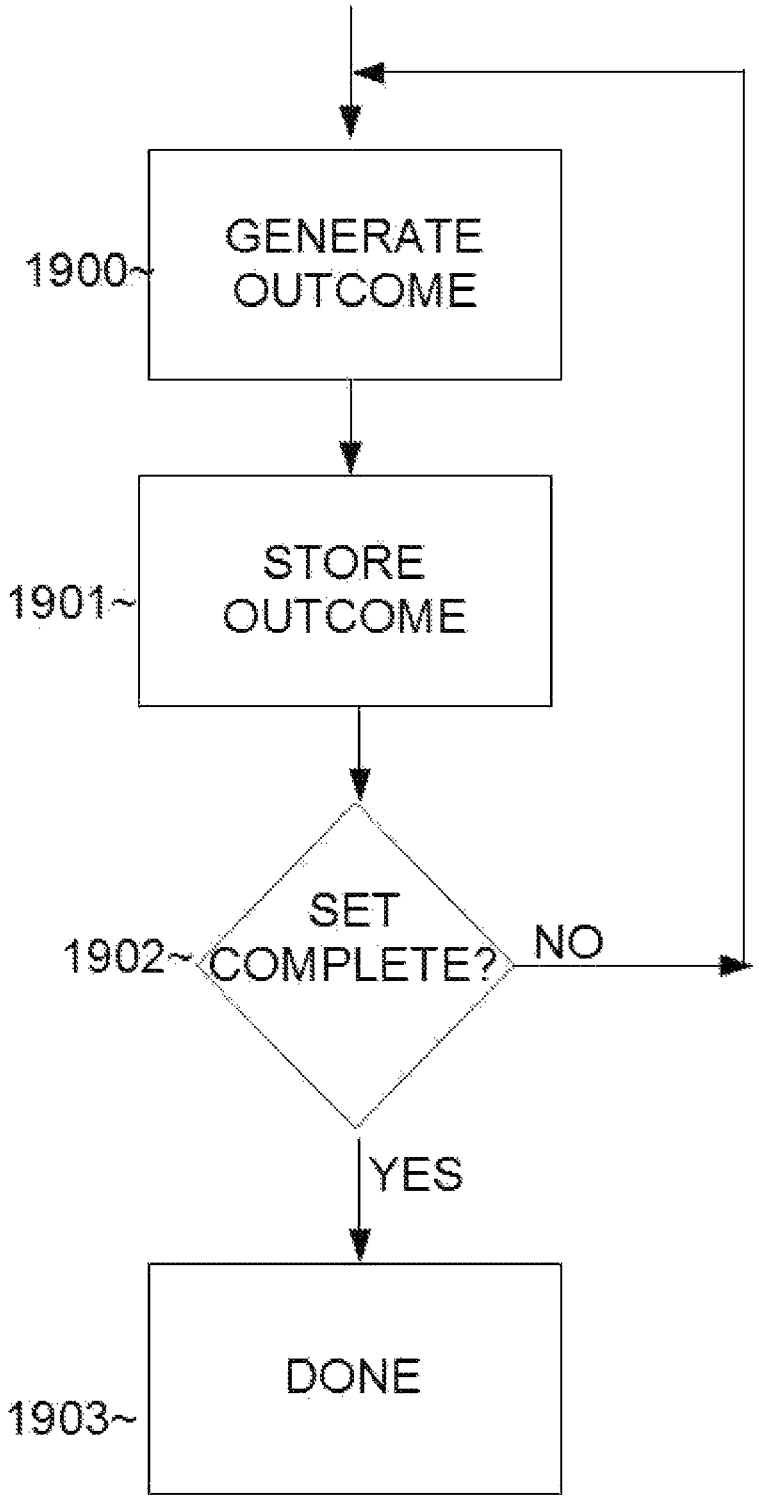
FIG. 19 is a flowchart illustrating an exemplary method of generated a set of potential outcomes, according to an embodiment.

FIG. 19 is a flowchart illustrating an exemplary method of generated a set of potential outcomes, according to an embodiment.

In operation 1900, an outcome is generated. This can be done by a mathematical model, for example, a random number or an outcome selected with a particular probability. For example, Table III below shows outcomes and respective probabilities.

TABLE III

| Award | probability |
|---|---|
| 1000 | 1% |
| 500 | 2% |
| 100 | 3% |
| 50 | 5% |
| 10 | 6% |
| 1 | 20% |
| 0 | 63% |

From operation 1900, the method proceeds to operation 1901, which stores the outcome determined in operation 1900 (in addition to all of the prior stored outcomes). This should be stored in a secure storage medium (e.g., hard disk, etc.) which is also accessible (directly or indirectly) by the game using the predetermined set.

From operation 1901, the method proceeds to operation 1902, which determines whether the set is complete. If a predetermined number of outcomes (results) has not yet been generated (e.g., 1,000,000 or other number) then the method returns to operation 1900 which continues to generate another outcome.

If in operation 1902, the set of predetermined results is complete, then the method proceeds to operation 1903 wherein the generation is done.

In a further embodiment, the predetermined set may be required to have a predetermined number of each outcome. For example, Table IV shows different frequencies for a predetermined set of 1,000 outcomes/awards. These can be converted into a set of potential/actual wins by populating the set with each award in its respective frequency and then shuffling the predetermined set so that the order of each award is random. If 1,000,000 awards are to be generated then the populating the set (of 1,000) can be done 1,000 times and then shuffled.

TABLE IV

| Frequency | award |
|---|---|
| 1 | 1,000 |
| 10 | 500 |
| 20 | 100 |
| 50 | 50 |
| 100 | 10 |
| 200 | 1 |
| 619 | 0 |

Figure 20:
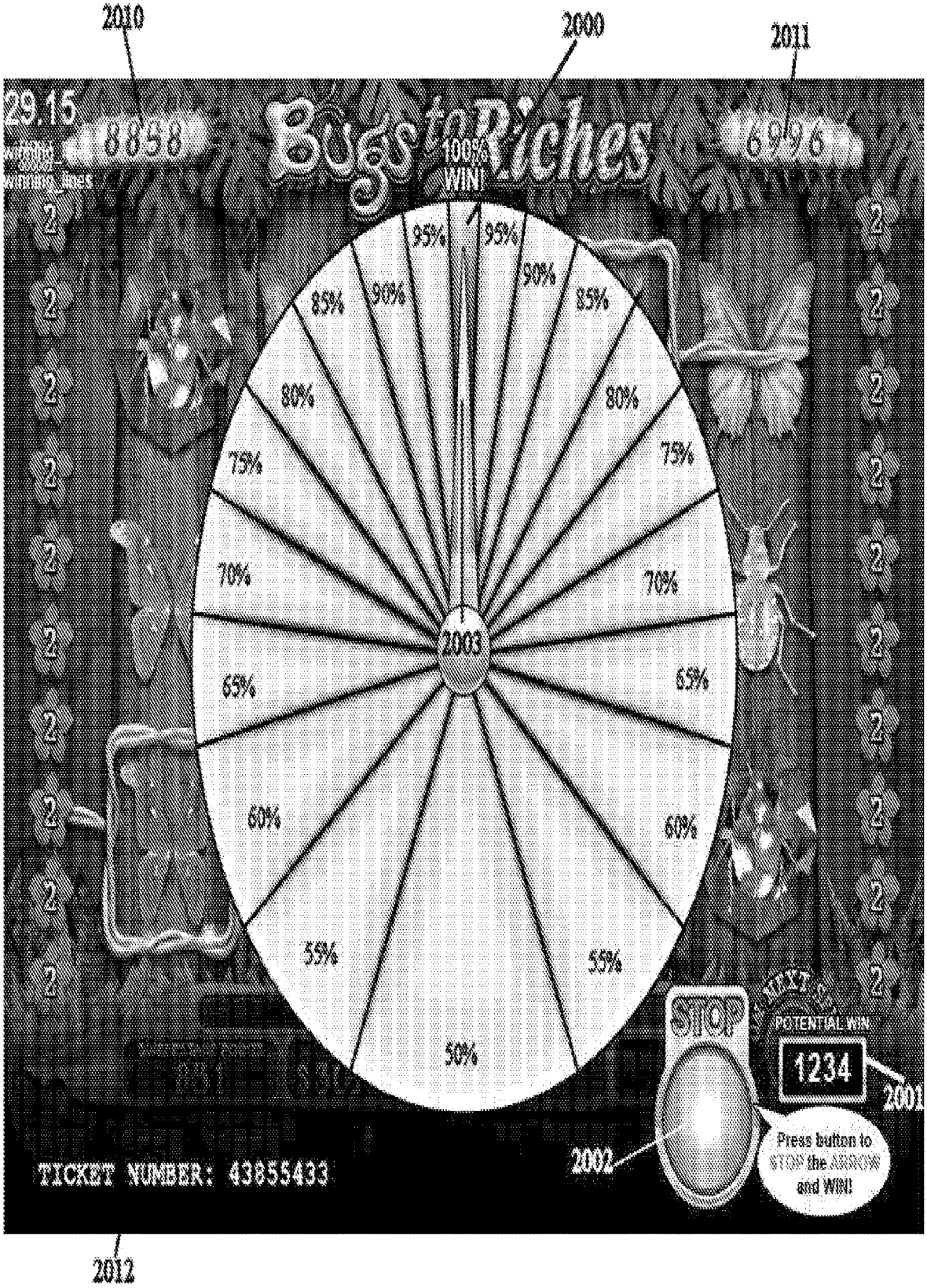
FIG. 20 is a screen shot of an exemplary embodiment with a round skill meter with unequally sized sections, according to an embodiment.

FIG. 20 is a screen shot of an exemplary embodiment with a round skill meter with unequally sized sections, according to an embodiment.

An icon 2003 continuously spins around the circular skill meter and the player presses the stop button 2002 when the player thinks the icon 2003 is going to stop in the 100% area 2000 which will award 100% of the potential award 2001. The speed the icon 2003 continuously spins at can be a constant speed (e.g., one revolution per second) or it can be variable. The potential win 2001 shows the maximum the player would win (the actual award) if the icon 2003 stops in the 100% area 2000, and the actual award is computed as the earned percentage of the potential win 2001. The earned percentage is where the icon 2003 stops when the stop button 2002 is pressed. So for example, if the icon 2003 stops at in the 90% area, then the actual award (the award the player actually receives) is 90% of the potential award (1,234) or 1,110.6 (which can be rounded up to 1,111 or down to 1,110). Instead of showing percentages, the percentages can be replaced by the actual awards that would be awarded when each slice (second) of the skill meter is where the icon 2003 would stop (become the frozen icon).

In another embodiment, the icon 2003 can remain stationary and the skill meter (the circle) can rotate around the icon 2003. Other than the fact that the icon 2003 remains stationary and the circle rotates (which is the opposite to the embodiment in the previous paragraph), this embodiment otherwise works the same. The player still presses the stop button 2002 in the same manner when he/she feels the circle will stop with the icon 2003 in the 100% area 2000 thus maximizing the player's actual award. The circle can rotate at one revolution per second or any other speed.

Note that the sections on the circle have different sizes, this results in making it more difficult for the player to avoid stopping the circle (or icon) in the larger sections and more difficult for the player to stop the circle (or icon) in the smaller sections.

Sweepstakes points balance 2010 shows how many Sweepstakes points the player has to play with. Each game costs a number of Sweepstakes points which are deducted from the Sweepstakes points balance 2010 upon each play of a game. When the Sweepstakes points balance 2010 reaches zero, the player can no longer play until the player replenishes the Sweepstakes points balance 2010 (e.g., by purchasing more phone time, requesting more Sweepstakes points in the mail, etc.) Win points balance 2011 shows how many win points the player has. Whenever the player wins an award (e.g., an actual award) on the slot game, this award is added to the win points balance 2011. The win points balance 2011 and the Sweepstakes points balance 2010 can be stored in an account associated with the player and/or on a card (e.g., with a magnetic identifying strip) used by the player to play the game. When the player wants to redeem the win points balance 2011, the player can request redemption on the machine and the player can receive a gift certificate to a store (such as the store the machine is located or another merchant) for a cash amount based on the number of win points the player has (e.g., 1 win point equals $1.00, or any other exchange ratio). The gift certificate can be printed out on the machine. The machine can also print out a voucher for cash which can be redeemed by the player at a desk (or kiosk) at the location the machine is located. When win points are redeemed of course they are deducted from the player's win points balance.

Ticket number indicator 2012 shows the ticket number that this game is displaying. Each potential outcome is predetermined and stored in a finite pool (as described herein). Each potential outcome has a ticket number which is incremented by one upon each successive game. The ticket number is actually the machine's pointer to the current place in the finite pool. The actual ticket number does not affect the game player and the player would typically not care what the ticket number is. Thus, for example, in FIG. 20, the ticket number is 43855433 which has stored in the computer system a potential win of 1,234 win points. The player's skill ultimately determines the player's final award (in win points) so that the game can be considered 100% skill based.

Figure 21:
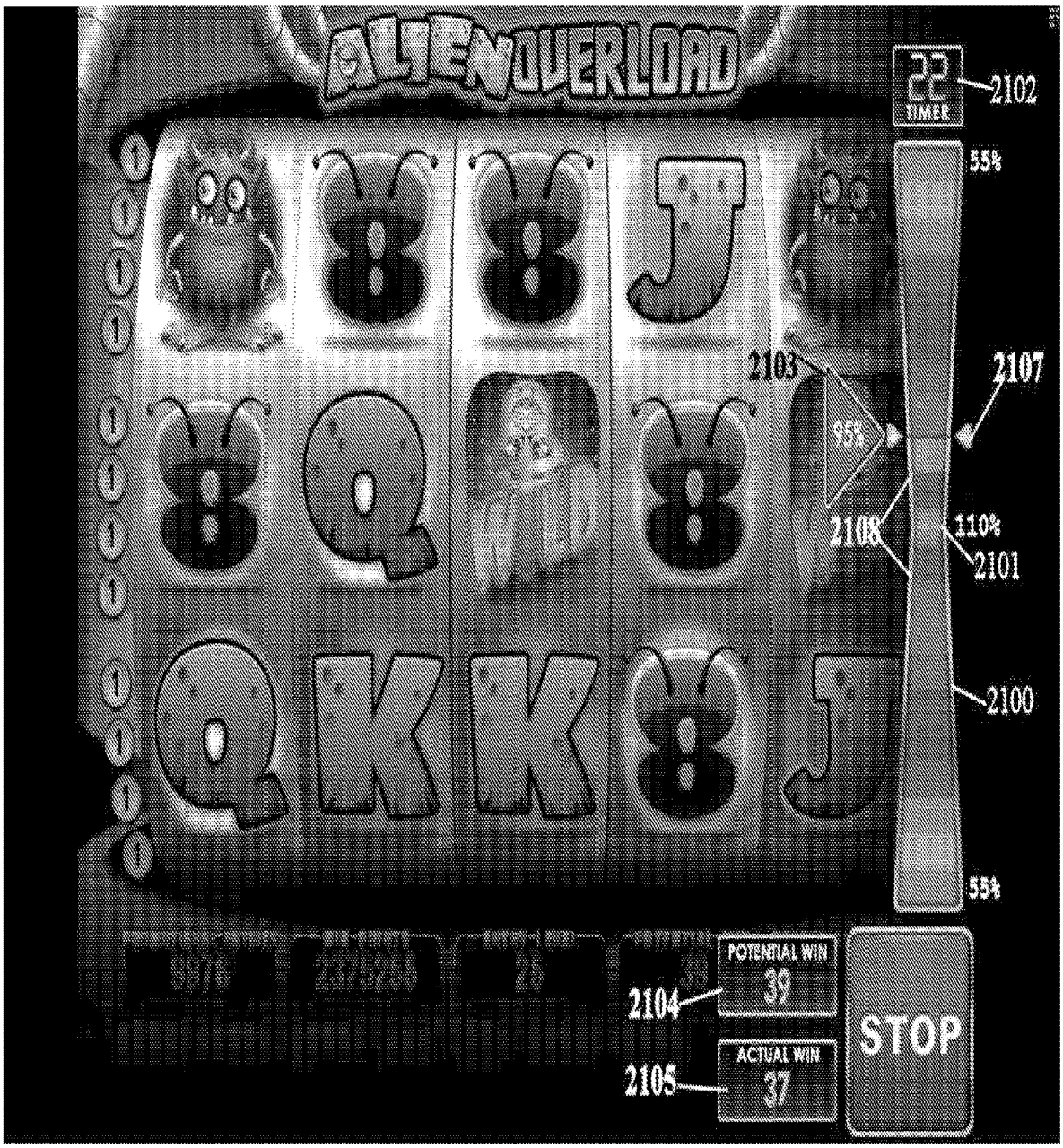
FIG. 21 is a screen shot of an exemplary embodiment with a vertical skill meter, according to an embodiment.

FIG. 21 is a screen shot of an exemplary embodiment with a vertical skill meter, according to an embodiment.

This example operates as described herein. An icon 2107 moves in a "ping pong" fashion, to the top, then to the bottom, then to the top, and continues repeating this motion. In the center of the skill meter 2100 is a 110% area 2101 which when the icon 2107 stops exactly on this 100% area 2101 the actual award 2105 will be 110% of the potential award 2104 (or 39). Of course it is very difficult for the player to stop the icon 2107 in the 110% area 2101, but it is possible. A 100% area 2108 would award the player 100% of the potential award 2104 as the actual award 2105 if the play can stop the icon 2107 in the 100% area 2108 (with the exception that the 110% area 2101 is inside the 100% area 2108 and would award 110%). Each section of the skill meter 2100 has its own earned percentage (the percentage of the potential award 2104 that is actually awarded to the player 2105) and of course the player's goal is to get the highest earned percentage the player can achieve using his/her own skill. An earned percentage output 2103 shows the current earned percentage based on where the icon 2107 is located. As the icon 2107 moves, the earned percentage output 2103 will vary depending on which section of the skill meter 2100 the icon 2107 is currently located in. Each section on the skill meter 2100 has its own respective earned percentage.

A timer 2102 shows how much time the player has left to press the stop button before the skill element of the game will automatically terminate (operations 1203-1204). If the player does not press the stop button before the timer 2102 reaches zero (when the animating of the icon 2107 begins it can start at any number of seconds, e.g., 30 seconds, etc. and count down each second) then the player can receive an earned percentage of 0% thus giving the player no actual award. In another embodiment, if the player fails to press the stop button before the timer 2102 reaches zero then the player can receive a random earned percentage. Thus, it is not in the player's interest to let the timer 2102 reach zero before pressing the stop button.

Figure 22:
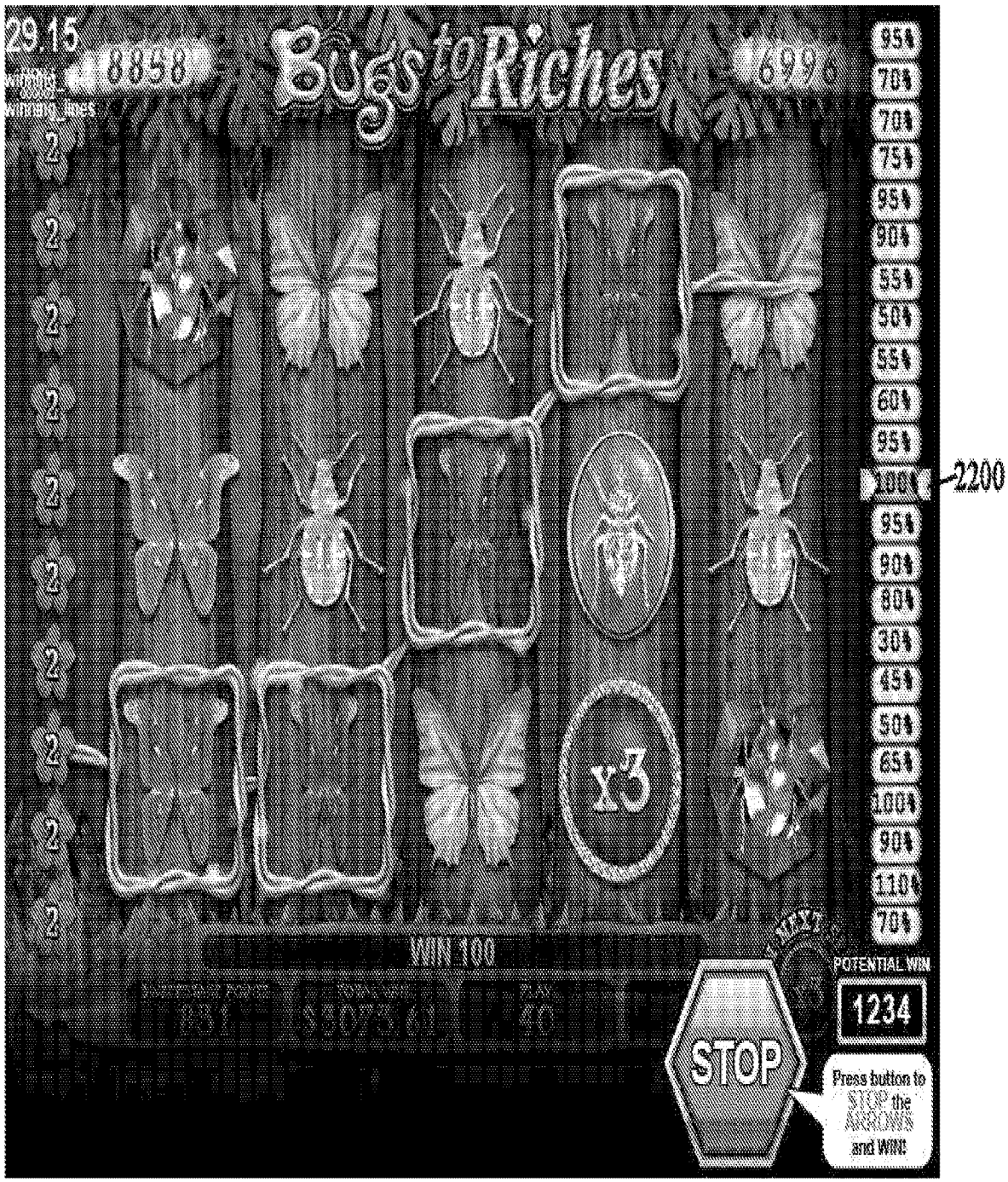
FIG. 22 is a screen shot of an exemplary embodiment with a vertical skill meter with a non-linear arrangement, according to an embodiment.

FIG. 22 is a screen shot of an exemplary embodiment with a vertical skill meter with a non-linear arrangement, according to an embodiment.

The icon 2200 animates in the up/down cycle as in FIG. 21. Note that the icon 2200 would point to one of the 23 bars each with its respective earned percentage that the player gets (percentage of the potential award) when the icon 2200 is stopped pointing to that bar. Note that the earned percentages are configured in a non-linearly fashion (not a continuous increase or decrease from the center to the top or bottom).

Figure 23:
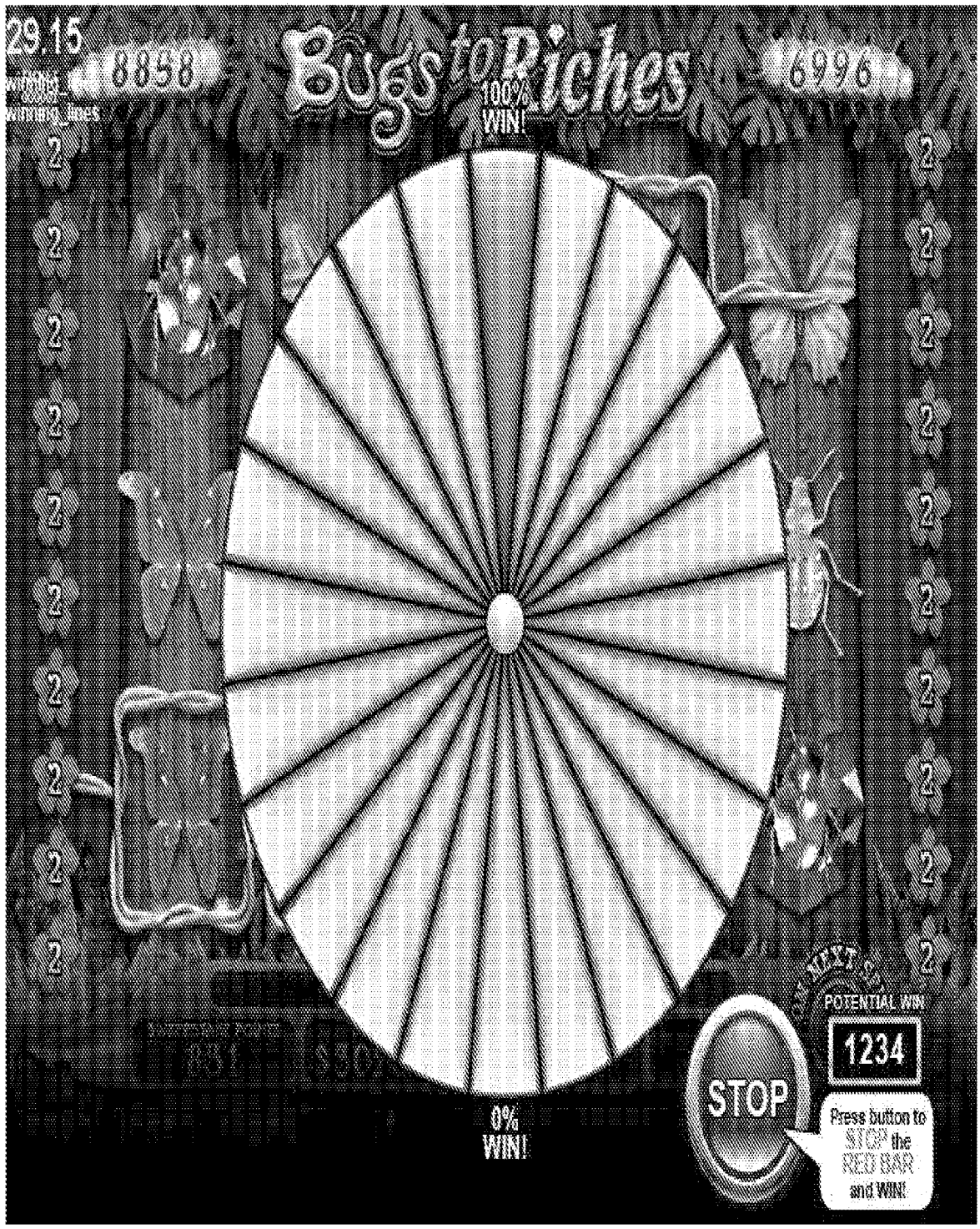
FIG. 23 is a screen shot showing an exemplary embodiment with a round skill meter with equal sections, according to an embodiment.

FIG. 23 is a screen shot showing an exemplary embodiment with a round skill meter with equal sections, according to an embodiment.

This embodiment operates in the same manner as the embodiment illustrated in FIG. 20 but not that each section on the circle is of equal size (unlike FIG. 20 in which sections of the circle have different sizes).

Figure 24:
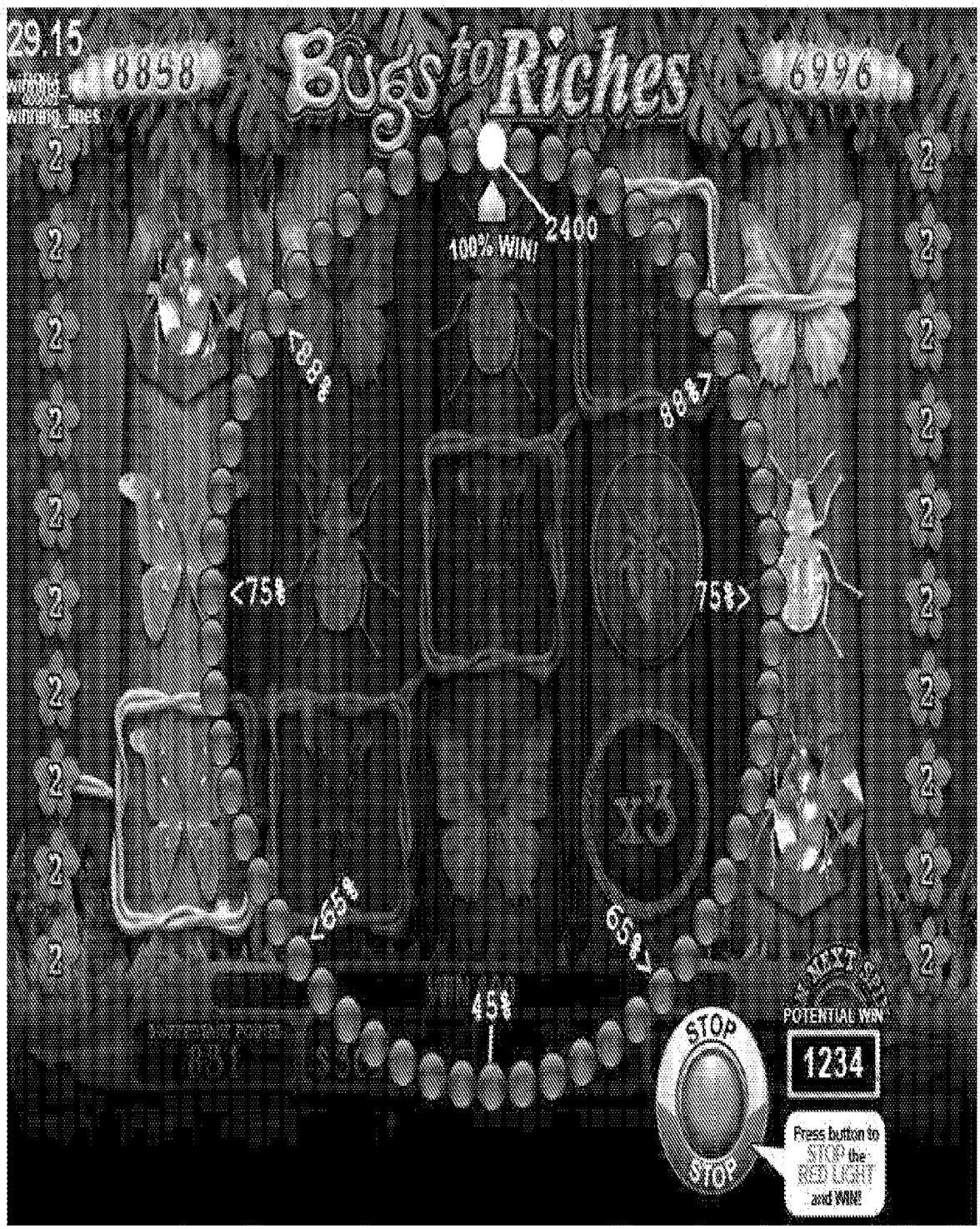
FIG. 24 is a screen shot of an exemplary embodiment showing another round skill meter.

FIG. 24 is a screen shot of an exemplary embodiment showing another round skill meter.

This embodiment has a round configuration of spots, each spot having its own earned percentage. This embodiment operates like the other embodiments, with the icon 2400 continuously rotating around the wheel (until the timer reaches zero). When the player (user) presses the stop button, the rotating icon 2400 becomes a frozen icon and the earned percentage is the percentage associated with the spot where the icon 2400 has stopped. While some of the earned percentages are labeled in the figure (e.g., 100%, 88%, 75%, 65%, 45%), all of the spots have an earned percentage and the earned percentage follows the pattern shown (e.g., the top spot awards 100%, then moving clockwise the earned percentages decrease for each spot until it reaches 45% (the bottom spot), and then the earned percentages increase for each spot until it reaches the 100% (top) spot again. The earned percentages for each spot (or section, bar, etc. in any other embodiment) typically remain fixed and do not change.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All features described herein can be combined with any other features without limitation.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

The invention claimed is:

1. A method, the method comprising:

providing an input device, an output device, and a processing unit operationally connected to the input device and the output device;

executing instructions on the processing unit which perform a following operations: receiving a wager from a player to play a game;

completing the game on the output device to a game outcome;

determining a potential award based on the game outcome;

animating an icon displayed on the output device until the player presses a stop button which causes the icon to become a frozen icon, wherein each possible position of the frozen icon is associated with a respective earned percentage with an optimal position of the frozen icon being associated with a respective earned percentage being a maximum possible percentage, wherein as the earned percentage decreases a distance between the frozen icon and the optimal position increases;

determining an actual earned percentage by using an associated earned percentage of a position of the frozen icon;

computing an actual award by applying the actual earned percentage to the potential award; and awarding the player the actual award.

2. The method as recited in claim 1, wherein the game is a reel slot machine game.

3. The method as recited in claim 2, wherein the wager comprises redeeming Sweepstakes points.

4. The method as recited in claim 1, wherein the maximum possible percentage is 100%.

5. The method as recited in claim 1, wherein the maximum possible percentage is more than 100%.

6. The method as recited in claim 1, wherein the completing the game comprises spinning reels on a slot machine and the game outcome is a final position of the reels.

7. An apparatus, the apparatus comprising:

an input device;

an output device;

a processing unit operationally connected to the input device and the output device, the processing unit configured to read and execute instructions, the instructions programmed to cause the processing unit to:

receive a wager from a player to play a game;

complete game on the output device to a game outcome;

determine a potential award based on the game outcome;

animate an icon displayed on the output device until the player presses a stop button which causes the icon to become a frozen icon, wherein each possible position of the frozen icon is associated with a respective earned percentage with an optimal position of the frozen icon being associated with a respective earned percentage being a maximum possible percentage, wherein as the earned percentage decreases a distance between the frozen icon and the optimal position increases;

determine an actual earned percentage by using an associated earned percentage of a position of the frozen icon;

compute an actual award by applying the actual earned percentage to the potential award; and award the player the actual award.

8. The apparatus as recited in claim 7, wherein the instructions are further programmed such that the game is a reel slot machine game.

9. The apparatus as recited in claim 7, wherein the instructions are further programmed such that the wager comprises redeeming Sweepstakes points.

10. The apparatus as recited in claim 7, wherein the instructions are further programmed such that the maximum possible percentage is 100%.

11. The apparatus as recited in claim 7, wherein the instructions are further programmed such that the maximum possible percentage is greater than 100%.

12. The apparatus as recited in claim 7, wherein the instructions are further programmed such that the complete the game comprises spinning reels and the game outcome is a final position of the reels.

13. An apparatus, the apparatus comprising:

an input device;

an output device;

a processing unit operationally connected to the input device and the output device, the processing unit configured to read and execute instructions, the instructions programmed to cause the processing unit to:

receive a wager from a player to play game;

complete the game on the output device to a game outcome;

determine a potential award based on the game outcome;

display a set of actual awards, the actual awards being determined as a function of the potential award;

animate an icon displayed on the output device until the player presses a stop button which causes the icon to become a frozen icon, wherein each possible position of the frozen icon is associated with an actual award in the set of actual awards with an optimal position of the frozen icon being associated with a maximum actual award, wherein as the actual award decreases a distance between the frozen icon and the optimal position increases;

determine an earned actual earned award using an actual award associated with a position of the frozen icon; and award the player the earned actual award.

14. The apparatus as recited in claim 13, wherein the instructions are further programmed such that the game is a reel slot machine game.

15. The apparatus as recited in claim 14, wherein the frozen icon is displayed on a same screen as reels on the reel slot machine game.

16. The apparatus as recited in claim 13, wherein the instructions are further programmed such that the wager comprises Sweepstakes points.

17. The apparatus as recited in claim 13, wherein the instructions are further programmed such that the complete the game comprises spinning reels and the game outcome is a final position of the reels.

* * * * *